US009075351B2

(12) United States Patent
Tabata et al.

(10) Patent No.: US 9,075,351 B2
(45) Date of Patent: Jul. 7, 2015

(54) CLEANING DEVICE

(71) Applicant: Konica Minolta, Inc., Tokyo (JP)

(72) Inventors: Eiji Tabata, Ibaraki (JP); Takuya Okada, Toyokawa (JP)

(73) Assignee: KONICA MINOLTA, INC., Tokyo (JP)

( * ) Notice: Subject to any disclaimer, the term of this patent is extended or adjusted under 35 U.S.C. 154(b) by 0 days.

(21) Appl. No.: 13/933,494

(22) Filed: Jul. 2, 2013

(65) Prior Publication Data

US 2014/0010567 A1 Jan. 9, 2014

(30) Foreign Application Priority Data

Jul. 3, 2012 (JP) ..... 2012-149497

(51) Int. Cl.
*G03G 15/16* (2006.01)

(52) U.S. Cl.
CPC ..... *G03G 15/161* (2013.01); *G03G 15/168* (2013.01); *G03G 2215/0132* (2013.01)

(58) Field of Classification Search
CPC G03G 15/161; G03G 15/168; G03G 15/0189
USPC ..... 399/101
See application file for complete search history.

(56) References Cited

U.S. PATENT DOCUMENTS

| | | | | |
|---|---|---|---|---|
| 3,879,124 | A | 4/1975 | Eppe et al. | |
| 4,538,898 | A * | 9/1985 | Kanno et al. | 399/274 |
| 5,091,753 | A * | 2/1992 | Slapelis | 399/349 |
| 5,416,572 | A * | 5/1995 | Kolb et al. | 399/350 |
| 5,761,573 | A * | 6/1998 | Haneda et al. | 399/66 |
| 5,822,666 | A * | 10/1998 | Haneda et al. | 399/309 |
| 5,873,015 | A * | 2/1999 | Christy | 399/296 |
| 7,623,812 | B2 * | 11/2009 | Kagawa | 399/176 |
| 8,879,946 | B2 * | 11/2014 | Watanabe | 399/101 |
| 2006/0204296 | A1 * | 9/2006 | Maruyama et al. | 399/349 |
| 2009/0035038 | A1 | 2/2009 | Sugimoto et al. | |

FOREIGN PATENT DOCUMENTS

| | | |
|---|---|---|
| JP | H05-508489 | 9/1982 |
| JP | 3-23483 | 1/1991 |
| JP | S53-142045 A1 | 11/1993 |
| JP | 6-250573 | 9/1994 |
| JP | 9-330002 | 12/1997 |
| JP | 3827279 | 9/2006 |

(Continued)

OTHER PUBLICATIONS

Machine translation of Wkabayashi 03-023483 , publication date: Jan. 31, 1991.*

(Continued)

*Primary Examiner* — Walter L Lindsay, Jr.
*Assistant Examiner* — Frederick Wenderoth
(74) *Attorney, Agent, or Firm* — Lucas & Mercanti, LLP

(57) ABSTRACT

A cleaning device for cleaning a cleaning subject moving in a predetermined direction, having; a cleaning member that rotates in an opposite direction from the predetermined direction at a contact with the cleaning subject, thereby gathering toner from the cleaning subject; and a shielding member that is disposed between the cleaning member and the cleaning subject in the predetermined direction relative to the contact and prevents the toner on the cleaning member from moving to the cleaning subject.

5 Claims, 19 Drawing Sheets

● N-CHARGED TONER
○ P-CHARGED TONER

(56) References Cited

FOREIGN PATENT DOCUMENTS

| | | |
|---|---|---|
| JP | 2007-334011 | 12/2007 |
| JP | 2009-37159 | 2/2009 |
| JP | 2009-92959 | 4/2009 |
| JP | 2010-170020 | 8/2010 |

OTHER PUBLICATIONS

Office Action (Notification of Reasons for Refusal) dated Nov. 18, 2014 for JP Application No. 2012-149497 and English translation thereof.

* cited by examiner

● N-CHARGED TONER
○ P-CHARGED TONER

CLEANING DEVICE

This application is based on Japanese Patent Application No. 2012-149497 filed on Jul. 3, 2012, the content of which is incorporated herein by reference.

BACKGROUND OF THE INVENTION

1. Field of the Invention

The present invention relates to cleaning devices, more particularly to a cleaning device for use in an image forming apparatus for forming a toner image on a printing medium.

2. Description of Related Art

As an invention related to a conventional cleaning device, a cleaning device described in, for example, Japanese Patent Laid-Open Publication No. 2007-334011 is known. FIG. 21 is a configuration diagram of the cleaning device 500 described in Japanese Patent Laid-Open Publication No. 2007-334011.

The cleaning device 500 is adapted to collect toner adhering to a secondary transfer roller 504, and includes a fur brush 506, a metal roller 508, and a cleaning blade 510, as shown in FIG. 21. The fur brush 506 is disposed in contact with the secondary transfer roller 504 so as to gather toner adhering to the secondary transfer roller 504.

The metal roller 508 is disposed in contact with the fur brush 506, and when a predetermined voltage is applied thereto, the metal roller 508 collects the toner gathered from the secondary transfer roller 504 by the fur brush 506. The cleaning blade 510 separates the toner from the surface of the metal roller 508. Thus, the secondary transfer roller 504 is cleaned.

However, in the cleaning device 500, toner on the fur brush 506 might readhere to the secondary transfer roller 504. More specifically, the metal roller 508 collects toner adhering to the fur brush 506. However, some of the toner remains on the fur brush 506 without being collected by the metal roller 508. The remaining toner is carried to the interface between the secondary transfer roller 504 and the fur brush 506 through rotation of the fur brush 506. Thereafter, due to the impact of the fur brush 506 contacting the secondary transfer roller 504, centrifugal force created by rotation of the fur brush 506, etc., the toner moves from the fur brush 506 to the secondary transfer roller 504, and readheres to the secondary transfer roller 504. Such toner readhesion might stain the back of a sheet of paper and deteriorate toner image quality.

SUMMARY OF THE INVENTION

In an embodiment of the present invention, a cleaning device for cleaning a cleaning subject moving in a predetermined direction includes: a cleaning member that rotates in an opposite direction from the predetermined direction at a contact with the cleaning subject, thereby gathering toner from the cleaning subject; and a shielding member that is disposed between the cleaning member and the cleaning subject in the predetermined direction relative to the contact and prevents the toner on the cleaning member from moving to the cleaning subject.

DETAILED DESCRIPTION OF THE PREFERRED EMBODIMENTS

Hereinafter, an image forming apparatus including a cleaning device according to an embodiment of the present invention will be described with reference to the drawings.

Configuration of Image Forming Apparatus

Figure 1:
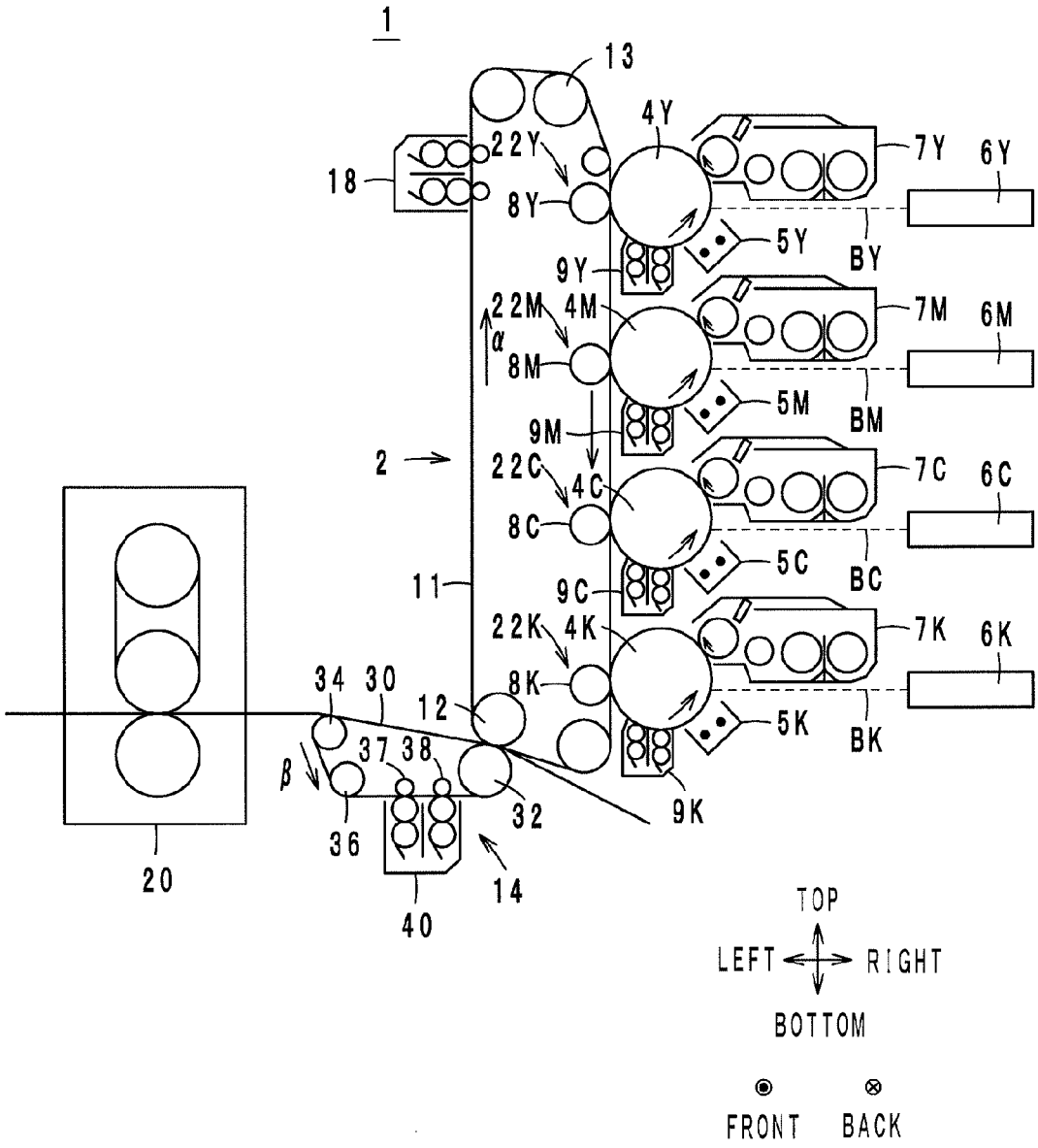
FIG. 1 is a diagram illustrating a substantial part (printing unit) of an image forming apparatus.

FIG. 1 is a diagram illustrating a substantial part (printing unit 2) of the image forming apparatus 1. The left-right direction, the front-back direction, and the top-bottom direction of the sheet of FIG. 1 will be simply referred to below as the left-right direction, the front-back direction, and the top-bottom direction, respectively, and the front-back direction corresponds to a main scanning direction.

The image forming apparatus 1 is an electrophotographic color printer of a so-called tandem type adapted to synthesize images in the four colors yellow (Y), magenta (M), cyan (C), and black (K). The image forming apparatus 1 has the function of forming an image on a sheet of paper on the basis of image data read by a scanner, and includes the printing unit 2, as shown in FIG. 1. Note that in addition to the printing unit 2, the image forming apparatus 1 includes a paper feeding unit and other components, which are common features and therefore any descriptions thereof will be omitted.

The printing unit 2 is adapted to form toner images on a sheet of paper supplied from the paper feeding unit, and includes imaging units 22 (22Y, 22M, 22C, and 22K), an optical scanning device (not shown), transfer units 8 (8Y, 8M, 8C, and 8K), an intermediate transfer belt 11, a drive roller 12, a driven roller 13, a secondary transfer unit 14, and cleaning devices 18 and 40. Moreover, the imaging unit 22 (22Y, 22M, 22C, 22K) includes a photoreceptor drum 4 (4Y, 4M, 4C, 4K), a charger 5 (5Y, 5M, 5C, 5K), an optical scanning device 6 (6Y, 6M, 6C, 6K), a developing device 7 (7Y, 7M, 7C, 7K), and a cleaning device 9 (9Y, 9M, 9C, 9K).

The photoreceptor drum 4 (4Y, 4M, 4C, 4K) has a cylindrical shape extending in the front-back direction. The photoreceptor drum 4 is an image support to be rotated counterclockwise in FIG. 1. The charger 5 (5Y, 5M, 5C, 5K) negatively charges the circumferential surface of the photoreceptor drum 4 (4Y, 4M, 4C, 4K).

The optical scanning device 6 (6Y, 6M, 6C, 6K) under control of a control unit (not shown) optically scans a beam B (BY, BM, BC, BK) over the circumferential surface of the photoreceptor drum 4 (4Y, 4M, 4C, 4K). The potential of the surface where the beam B (BY, BM, BC, BK) is scanned approximates to 0V. As a result, an electrostatic latent image is formed on the circumferential surface of the photoreceptor drum 4 (4Y, 4M, 4C, 4K).

The developing device 7 (7Y, 7M, 7C, 7K) applies toner to the photoreceptor drum 4 (4Y, 4M, 4C, 4K), and develops a toner image based on the electrostatic latent image. More specifically, the developing device 7 (7Y, 7M, 7C, 7K) contains a developer consisting of toner and carrier, and the developer is stirred to negatively charge the toner while positively charging the carrier. The developing device 7 (7Y, 7M, 7C, 7K) applies the negatively charged toner to the photoreceptor drum 4 (4Y, 4M, 4C, 4K). As a result, the negatively charged toner adheres to the surface where the beam B (BY, BM, BC, BK) is scanned (i.e., where the potential is nearly 0V). Thus, a toner image is developed.

The intermediate transfer belt 11 is stretched between the drive roller 12 and the driven roller 13. The toner image developed on the photoreceptor drum 4 (4Y, 4M, 4C, 4K) is subjected to primary transfer onto the intermediate transfer belt 11. The transfer unit (8Y, 8M, 8C, 8K) is disposed so as to face the inner circumferential surface of the intermediate transfer belt 11, and plays the role of subjecting the toner image formed on the photoreceptor drum 4 (4Y, 4M, 4C, 4K) to primary transfer onto the intermediate transfer belt 11. Specifically, the transfer unit (8Y, 8M, 8C, 8K) is kept at a higher potential than the photoreceptor drum 4 (4Y, 4M, 4C, 4K). As a result, the negatively charged toner image is transferred from the photoreceptor drum 4 (4Y, 4M, 4C, 4K) onto the intermediate transfer belt 11.

The cleaning device 9 (9Y, 9M, 9C, 9K) collects toner that remains on the circumferential surface of the photoreceptor drum 4 (4Y, 4M, 4C, 4K) after primary transfer. The drive roller 12 is rotated by an intermediate transfer belt driving unit (not shown in FIG. 1), thereby driving the intermediate transfer belt 11 in direction a. As a result, the intermediate transfer belt 11 carries the toner image to the secondary transfer unit 14. Examples of the material of the intermediate transfer belt 11 include resins, such as polyimide, polycarbonate, and polyester, and various types of rubber that contain conductive materials, and the intermediate transfer belt 11 preferably has a volume resistivity of from $10^5$ Ω·cm to $10^{12}$ Ω·cm.

The secondary transfer unit 14 faces the drive roller 12 where the intermediate transfer belt 11 is wound, and has a belt 30 and rollers 32, 34, 36, 37, and 38. The belt 30 is stretched around the rollers 32, 34, 36, 37, and 38. The rollers 32, 34, 36, 37, and 38 are, for example, aluminum rollers. The roller 32 is rotated by a belt driving unit (not shown in FIG. 1), thereby driving the belt 30 in direction β (counterclockwise). Moreover, the roller 32 is kept at a higher potential than the intermediate transfer belt 11, so that the toner image supported on the intermediate transfer belt 11 is subjected to secondary transfer onto a sheet of paper passing between the intermediate transfer belt 11 and the belt 30. The cleaning device 18 gathers toner that remains on the intermediate transfer belt 11 after secondary transfer of the toner image onto the sheet. The cleaning device 40 gathers toner adhering to the cleaning subject, i.e., the belt 30. Examples of the material of the belt 30 include resins, such as polyimide, polycarbonate, and polyester, and various types of rubber that contain conductive materials, and the belt 30 preferably has a volume resistivity of from $10^5$ Ω·cm to $10^{12}$ Ω·cm.

A fusing device 20 performs heating and pressing on the sheet with the toner image subjected to secondary transfer. As a result, the toner image is fixed on the sheet. Thereafter, the sheet is outputted from the image forming apparatus 1.

Configuration of Cleaning Device

Figure 2:
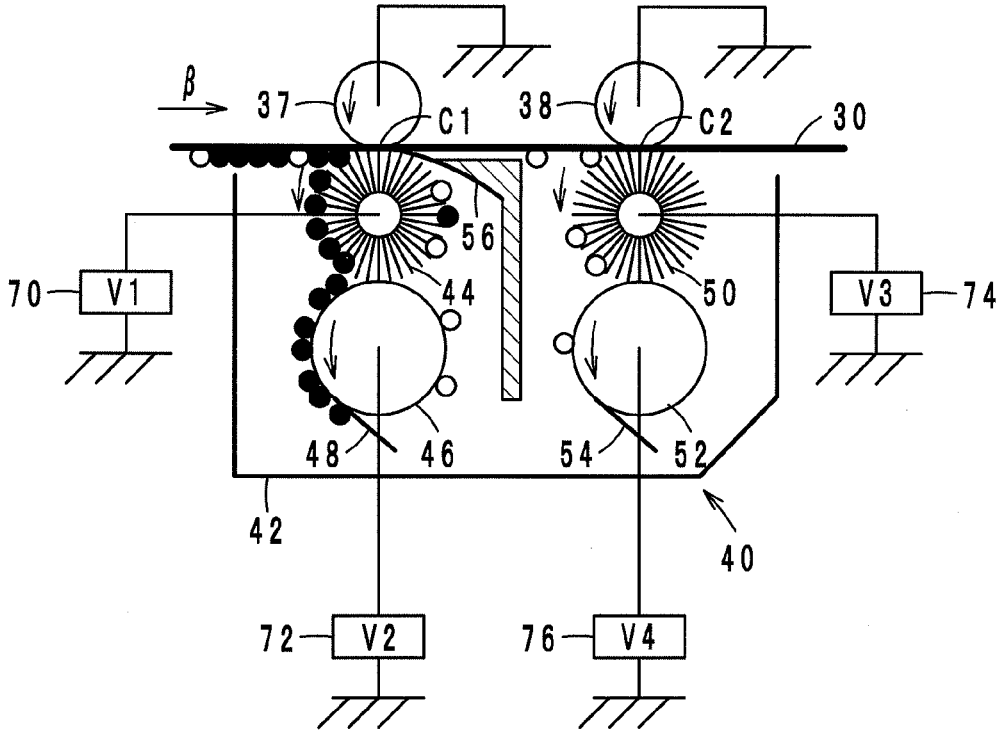
FIG. 2 is a configuration diagram of a cleaning device.
Figure 2:
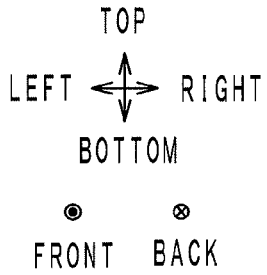
Figure 3:
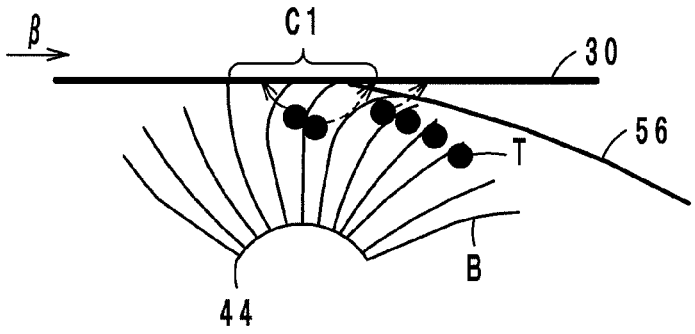
FIG. 3 is an enlarged view of a cleaning brush.

Next, the configuration of the cleaning device 40 will be described with reference to the drawings. FIG. 2 is a configuration diagram of the cleaning device 40. FIG. 3 is an enlarged view of a cleaning brush 44.

The cleaning device 40 is adapted to collect the toner that has been transferred from the intermediate transfer belt 11 and adheres to the belt 30, and includes a housing 42, the cleaning brush 44, a cleaning brush 50, collecting rollers 46 and 52, scrapers 48 and 54, and a shielding member 56, as shown in FIG. 2.

The housing 42 is in the shape of a box with an opening at the top, and accommodates the cleaning brushes 44 and 50, the collecting rollers 46 and 52, the scrapers 48 and 54, and the shielding member 56.

The cleaning brush 44 (cleaning member) rotates counterclockwise to move in the opposite direction (leftward) to direction β (rightward) at a contact C1 with the belt 30, thereby removing toner from the belt 30, as shown in FIG. 2. The cleaning brush 44 is a cylindrical brush extending in the front-back direction. The belt 30 bites into the cleaning brush 44, as shown in FIG. 3. The term "bite" is intended to mean that the minimum distance from the center of the cleaning brush 44 to the belt 30 is shorter than the radius of the cleaning brush 44. The contact C1 is an area where the belt 30 bites into and thereby contacts the cleaning brush 44, as shown in FIG. 3.

Furthermore, the cleaning brush 44 is opposed to the roller 37, which is kept at a ground potential, with respect to the belt 30. The cleaning brush 44 is kept at a positive potential V1, which is higher than a potential V0 (ground potential) of the belt 30, through voltage application by a power source 70. Therefore, negatively charged toner adhering to the belt 30 is gathered by the cleaning brush 44. Specifically, a voltage is applied between the belt 30 and the cleaning brush 44, such that the negatively charged toner moves from the belt 30 to the cleaning brush 44.

However, there is also positively charged toner on the belt 30. Such positively charged toner is carried on the belt 30 in direction β (rightward) without being gathered by the cleaning brush 44.

For example, the cleaning brush 44 is made of a fibrous material provided with conductivity by dispersing carbons in resin such as nylon, polyester, acrylic, or rayon. The cleaning brush 44 has a fineness of from 1 denier [D] to 10 D, a fiber density of from 75 kilofilaments per square inch [kF/inch$^2$] to 450 kF/inch$^2$, and a resistance of from $10^5\Omega$ to $10^{13}\Omega$ per unit length of raw yarn.

The collecting roller 46 collects the negatively charged toner gathered by the cleaning brush 44. More specifically, the collecting roller 46 rotates counterclockwise while contacting the bottom of the cleaning brush 44, as shown in FIG. 2. The collecting roller 46 bites into the cleaning brush 44. The collecting roller 46 is kept at a positive potential V2, which is higher than the potential V1 of the cleaning brush 44, through voltage application by a power source 72. That is, the potential V2 of the collecting roller 46 and the potential V1 of the cleaning brush 44 are equal in polarity, and the potential V2 of the collecting roller 46 is greater in magnitude than the potential V1 of the cleaning brush 44. Thus, the negatively charged toner gathered by the cleaning brush 44 is collected by the collecting roller 46. The collected negatively charged toner is separated from the circumferential surface of the collecting roller 46 by the scraper 48. As a result, the negatively charged toner is stored to the housing 42.

The collecting roller 46 is, for example, an aluminum roller. Moreover, the scraper 48 is made of a thin stainless steel plate having a thickness of, for example, 0.08 mm. Note that the scraper 48 may be made of rubber or resin.

Incidentally, the potential V2 of the collecting roller 46 is kept at a positive potential level higher than the potential V1 of the cleaning brush 44. Accordingly, some of the negatively charged toner is changed into positively charged toner by discharge or charge injection, which occurs between the collecting roller 46 and the cleaning brush 44. Such positively charged toner is not collected from the cleaning brush 44 by the collecting roller 46. Moreover, there is a possibility that the positively charged toner reaches the right end of the contact C1 through rotation of the cleaning brush 44, and readheres to the belt 30 due to an electric field between the belt 30 and the cleaning brush 44.

Furthermore, some of the negatively charged toner remains on the cleaning brush 44 without being collected from the cleaning brush 44 by the collecting roller 46. There is a possibility that the negatively charged toner reaches the right end of the contact C1 through rotation of the cleaning brush 44, and readheres to the belt 30 due to the impact of bristles of the cleaning brush 44 hitting the belt 30. Moreover, an increase in the amount of charge of the opposite polarity on the surface of the belt 30 enhances the possibility that the negatively charged toner readheres to the belt 30 due to the electric field between the cleaning brush 44 and the belt 30.

Therefore, the shielding member 56 is provided for the purpose of inhibiting both the positively charged toner and the negatively charged toner from readhering to the belt 30. The shielding member 56 is a sheet-like member disposed between the cleaning brush 44 and the belt 30 in direction β relative to the contact C1, as shown in FIGS. 2 and 3. The shielding member 56 is fixed at the right end (the end in direction β) to the housing 42. Moreover, the left end (the opposite end from direction β, simply referred to below as the tip) of the shielding member 56 is positioned at or near the contact C1. In the present embodiment, the tip of the shielding member 56 is positioned at the contact C1. Thus, the positively charged toner and the negatively charged toner on the cleaning brush 44 can be prevented from adhering to the belt 30 near the right end of the contact C1.

The cleaning brush 50 is disposed downstream from the cleaning brush 44 in direction β (the moving direction of the belt 30), as shown in FIG. 2, and is rotated counterclockwise toward the opposite direction from direction β at a contact C2 with the belt 30, thereby collecting toner on the belt 30. The cleaning brush 50 is a cylindrical brush extending in the front-back direction. The belt 30 bites into the cleaning brush 50. Moreover, the amount of bite in the cleaning brush 50 by the belt 30 is approximately equal to the amount of bite in the cleaning brush 44 by the belt 30. The term "the amount of bite" herein is intended to mean the difference between the radius of the cleaning brush 44 or 50 and the minimum distance from the center of the cleaning brush 50 to the belt 30. The contact C2 is an area where the belt 30 bites into and thereby contacts the cleaning brush 50.

Furthermore, the cleaning brush 50 is opposed to the roller 38, which is kept at the ground potential, with respect to the belt 30. The cleaning brush 50 is kept at a negative potential V3, which is lower than the potential V0 (ground potential) of the belt 30, due to voltage application by a power source 74. Thus, positively charged toner adhering to the belt 30 is gathered by the cleaning brush 50.

For example, the cleaning brush 50 is made of a fibrous material provided with conductivity by dispersing carbons in resin such as nylon, polyester, acrylic, or rayon. The cleaning brush 50 has a fineness of from 1 D to 10 D, a fiber density of from 75 kF/inch$^2$ to 450 kF/inch$^2$, and a resistance of from $10^5\Omega$ to $10^{13}\Omega$ per unit length of raw yarn.

The collecting roller 52 collects the positively charged toner gathered by the cleaning brush 50, as shown in FIG. 2. More specifically, the collecting roller 52 contacts the bottom of the cleaning brush 50 while rotating counterclockwise, as shown in FIG. 2. The collecting roller 52 bites into the cleaning brush 50. The collecting roller 52 is kept at a negative potential V4, which is lower than the potential V3 of the cleaning brush 50, due to voltage application by a power source 76. That is, the potential V4 of the collecting roller 52 and the potential V3 of the cleaning brush 50 are equal in polarity, and the potential V4 of the collecting roller 52 is greater in magnitude than the potential V3 of the cleaning brush 50. Thus, the positively charged toner gathered by the cleaning brush 50 is collected by the collecting roller 52. The collected positively charged toner is then separated from the circumferential surface of the collecting roller 52 by the scraper 54. As a result, the positively charged toner is stored to the housing 42.

The collecting roller 52 is, for example, an aluminum roller. Moreover, the scraper 54 is made of, for example, a thin stainless steel plate having a thickness of 0.08 mm. Note that the scraper 54 may be made of rubber or resin.

The cleaning device 40 thus configured is used for cleaning the belt 30. However, the cleaning device 18 for cleaning the intermediate transfer belt 11 or the cleaning device 9 (9Y, 9M, 9C, 9K) for cleaning the photoreceptor drum 4 (4Y, 4M, 4C, 4K) may have the same configuration as the cleaning device 40. Note that the polarity of the voltage to be applied to the cleaning device 40 is appropriately changed depending on the polarity of toner to be cleaned.

Effects

The cleaning device 40 thus configured inhibits toner readhesion to the belt 30. More specifically, in the cleaning device 500 described in Japanese Patent Laid-Open Publication No. 2007-334011, the metal roller 508 collects toner adhering to the fur brush 506. However, some of the toner remains on the fur brush 506 without being collected by the metal roller 508. Through rotation of the fur brush 506, the remaining toner is carried to the point where the fur brush 506 meets the secondary transfer roller 504. Thereafter, due to the impact of the fur brush 506 contacting the secondary transfer roller 504, centrifugal force created by rotation of the fur brush 506, etc., the toner moves from the fur brush 506 to the secondary transfer roller 504, and readheres to the secondary transfer roller 504. Such toner readhesion might stain the back of a sheet of paper and deteriorate toner image quality.

Therefore, the shielding member 56 is disposed between the cleaning brush 44 and the belt 30 in direction β relative to the contact C1, as shown in FIGS. 2 and 3. Moreover, the tip of the shielding member 56 is positioned at or near the contact C1. Thus, toner readhesion to the belt 30 is inhibited, as will be described below.

More specifically, toner T adheres to the tip of bristles B of the cleaning brush 44, as shown in FIG. 3. The toner T moves from the bristles B of the cleaning brush 44 to the belt 30 due to the impact of the bristles B of the cleaning brush 44 hitting the shielding member 56 and the belt 30, and centrifugal force applied by the cleaning brush 44. At this time, some of the toner T leaps out from the bristles B in the opposite direction (leftward) from direction β, as indicated by a solid arrow. The toner T that leaped out is collected by following bristles B of the cleaning brush 44. On the other hand, some other toner T leaps out from the bristles B in direction β (rightward), as indicated by dotted arrows. The toner T that leaped out readheres to the belt 30 outside the contact C1, and therefore is not collected by following bristles B of the cleaning brush 44.

Therefore, the shielding member 56 is disposed between the cleaning brush 44 and the belt 30 in direction β relative to the contact C1, as shown in FIG. 2. Moreover, the tip of the shielding member 56 is positioned at or near the contact C1. As a result, even when toner leaps out from bristles B of the cleaning brush 44 in direction β due to the impact of the bristles B hitting the shielding member 56 and the belt 30, and centrifugal force applied by the cleaning brush 44, the toner adheres to the shielding member 56 but does not adhere to the belt 30. Moreover, while the cleaning brush 44 is rotating, the toner is collected by following bristles B of the cleaning brush 44. Thus, toner readhesion to the belt 30 is inhibited.

Furthermore, in the cleaning device 40, the shielding member 56 blocks the electric field between the belt 30 and the cleaning brush 44. Thus, positively charged toner and negatively charged toner are inhibited from readhering to the belt 30 due to the electric field.

Furthermore, the cleaning device 40 inhibits toner readhesion to the belt 30 without decreasing its cleaning performance. More specifically, to reduce toner readhesion to the belt 30, for example, the amount of bite in the cleaning brush 44 by the belt 30 or the difference in speed (circumferential speed) between the belt 30 and the cleaning brush 44 is reduced. As a result, the impact of the bristles B of the cleaning brush 44 contacting the belt 30 is reduced, thereby inhibiting toner from leaping out from the bristles B. Moreover, electrostatic force that occurs between the cleaning brush 44 and the belt 30 is reduced, thereby making it less possible for toner to move from the cleaning brush 44 to the belt 30.

However, reducing the amount of bite in the cleaning brush 44 by the belt 30 and reducing the difference in speed between the belt 30 and the cleaning brush 44 might cause reduction in cleaning performance of the cleaning device 40.

Therefore, the cleaning device 40 inhibits toner readhesion to the belt 30 by the shielding member 56, as described earlier. Thus, the cleaning device 40 makes it possible to inhibit toner readhesion to the belt 30 without decreasing its cleaning performance.

Furthermore, some of the toner gathered by the cleaning brush 44 remains on the cleaning brush 44 without being collected by the collecting roller 46. Some of the toner remaining in the cleaning brush 44 accumulates in the cleaning brush 44 without readhering to the belt 30. Thereafter, as the amount of toner accumulating in the cleaning brush 44 increases, the possibility that the toner leaks out of the cleaning brush 44 and readheres to the belt 30 increases. However, the cleaning device 40 is provided with the shielding member 56, and therefore, the toner that leaks out of the cleaning brush 44 is inhibited from readhering to the belt 30.

Here, a preferred position of the shielding member 56 will be described with reference to the drawings. For the following first and second reasons, the minimum distance between the tip of the shielding member 56 and the contact C1 is preferably less than the amount of bite in the cleaning brush 44 by the belt 30.

Figure 4:
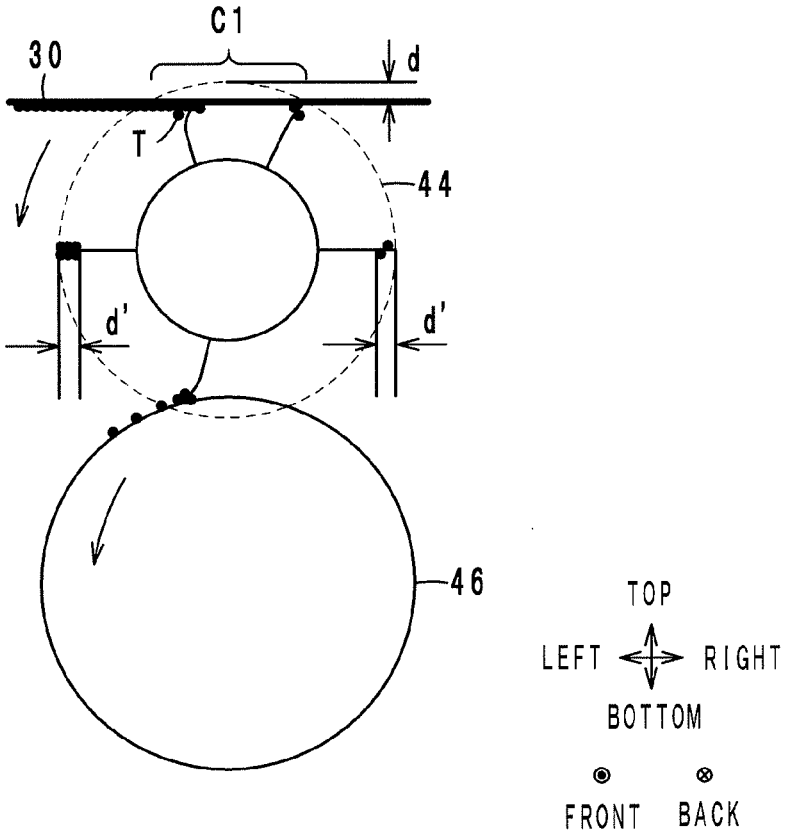
FIG. 4 is another enlarged view of the cleaning brush.
Figure 5:
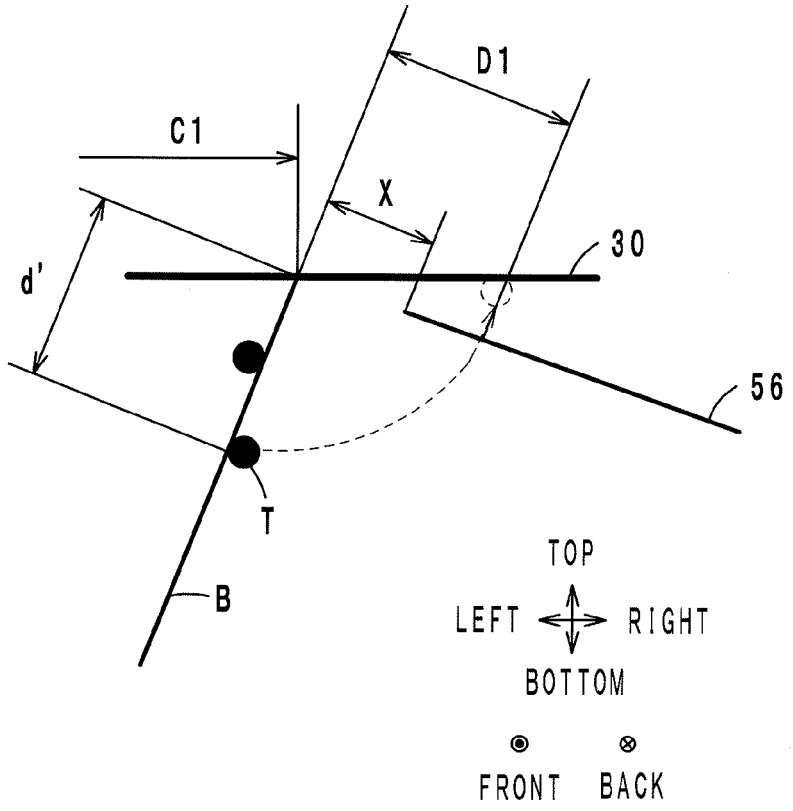
FIG. 5 is an enlarged view of the right end of a contact C1.

The first reason will now be described. FIG. 4 is an enlarged view of the cleaning brush 44. FIG. 5 is an enlarged view of the right end of the contact C1. As shown in FIG. 4, the amount of bite in the cleaning brush 44 by the belt 30 will be denoted by d.

When the belt 30 bites into the cleaning brush 44, the tip of the bristle B is pressed against the belt 30 and therefore flexed, as shown in FIG. 4. As a result, toner T adheres to the bristle B in the range from the tip to its proximal portion. Here, the length of the range from the tip to its proximal portion of the bristle B to which the toner adheres will be denoted by d'.

When the amount of toner T adhering to the belt 30 is high, the length d' is approximately equal to the amount of bite d. On the other hand, when the amount of toner adhering to the belt 30 is low, the length d' is less than the amount of bite d. However, the case in which toner readhesion causes a problem is when the amount of toner T adhering to the belt 30 is high. Therefore, the length d' can be considered approximately equal to the amount of bite d. Moreover, toner T remaining on the cleaning brush 44 without being collected by the collecting roller 46 lies within the range of the length d' from the tip of the bristle B.

Therefore, discussed below is a case where toner T distanced at the length d' from the tip of the bristle B leaps out toward the belt 30. In this case, the toner T leaps out rightward due to the impact of the bristle B hitting the belt 30, as indicated by the dotted line in FIG. 5. In the case where no shielding member 56 is provided, the toner T adheres to the belt 30 at a distance D1 from the tip of the bristle B (i.e., from the right end of the contact C1). Accordingly, the distance X between the tip of the shielding member 56 and the contact C1 is designed to be shorter than the distance D1. As a result, the shielding member 56 prevents the toner T from readhering to the belt 30. The distance D1 depends on the length d'. Since the length d' is approximately equal to the amount of bite d, the distance D1 depends on the amount of bite d. The distance D1 is determined by the amount of charge in the toner, the direction and intensity of electric field, centrifugal force and air resistance applied to the toner, etc. However, normally, the readhering toner has weak charge, and therefore, is electrically weak, and centrifugal force and air resistance applied to the toner are not very significant. Therefore, the distance D1 greatly depends on the amount of bite d. The present inventors conducted experimentation to be described later and confirmed that the above hypothetical effect could actually be produced. Thus, the minimum distance X between the tip of the shielding member 56 and the contact C1 is preferably less than the amount of bite d.

The phenomenon as described in the above first reason occurs where the cleaning brush 44 has relatively low density bristles B.

Figure 6:
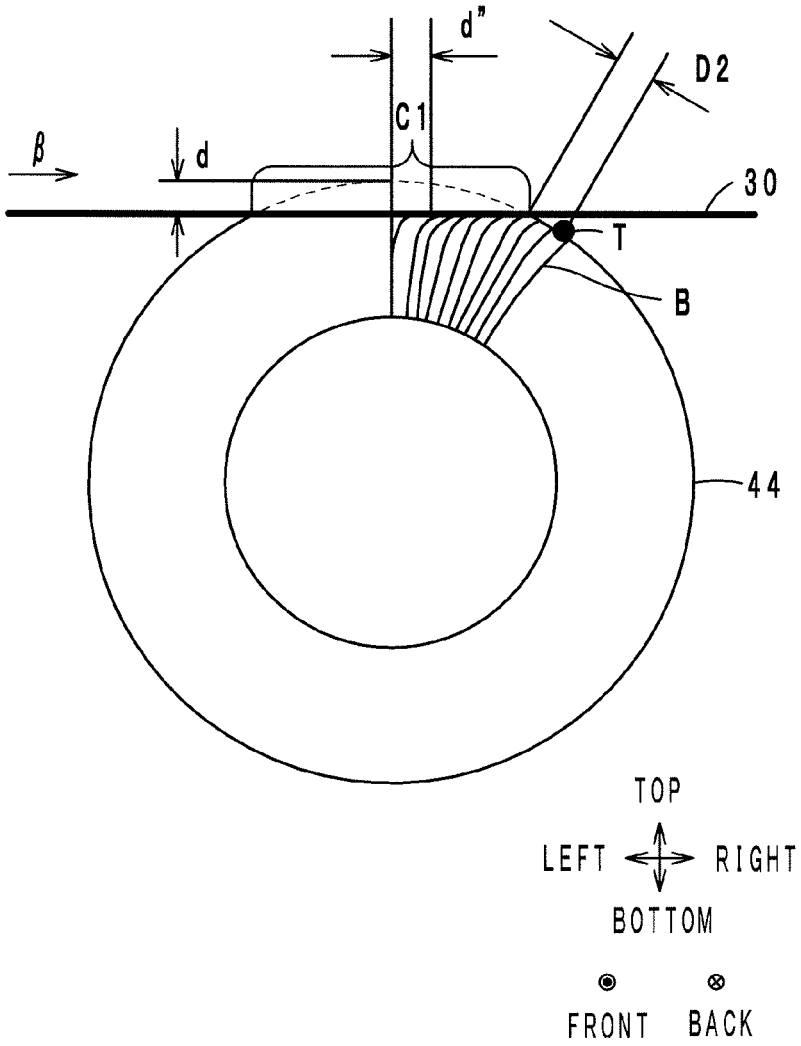
FIG. 6 is another enlarged view of the cleaning brush.
Figure 7A:
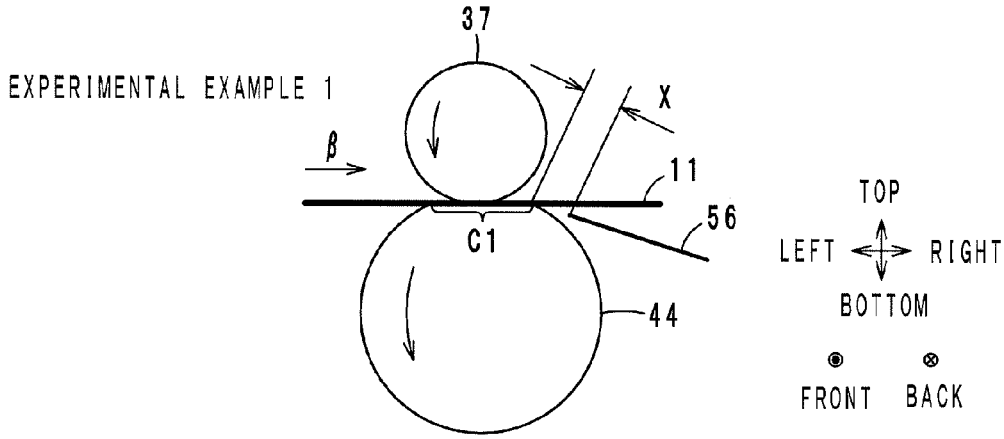
FIG. 7A is an enlarged view of a cleaning brush and its vicinity in a first experimental example used in experimentation.
Figure 7B:
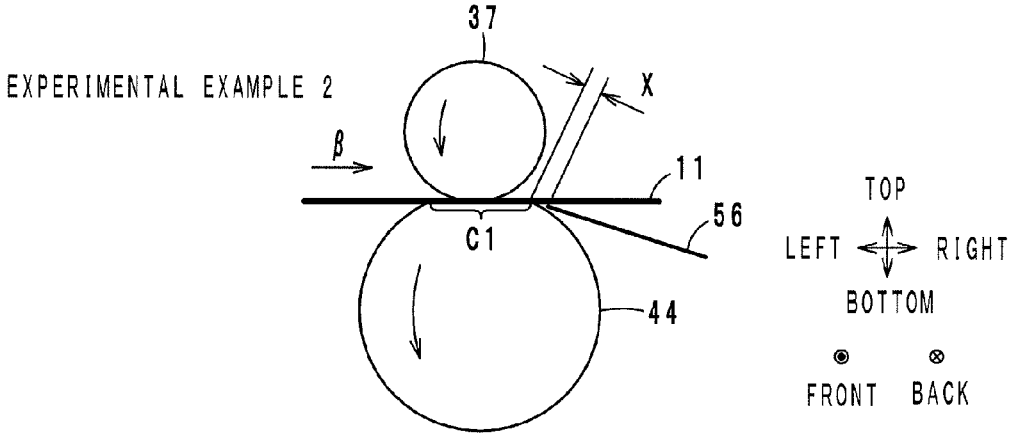
FIG. 7B is an enlarged view of a cleaning brush and its vicinity in a second experimental example used in experimentation.
Figure 7C:
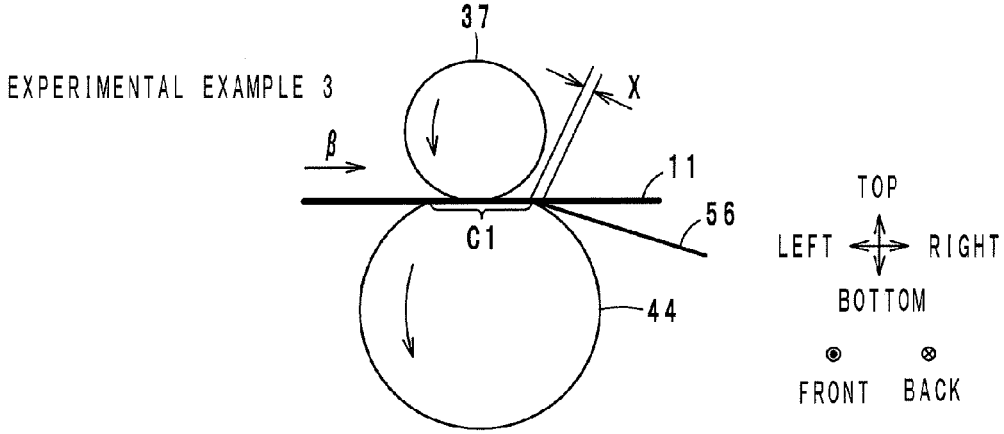
FIG. 7C is an enlarged view of a cleaning brush and its vicinity in a third experimental example used in experimentation.

The second reason will be described next. FIG. 6 is an enlarged view of the cleaning brush 44. As shown in FIG. 6, the amount of the bristle B being flexed by the belt 30 will be referred to as the amount of flexing d". Note that the number of bristles B shown in FIG. 6 is less than in reality, and a greater number of bristles B are actually provided.

The belt 30 bites into the cleaning brush 44. Accordingly, bristles B are flexed in direction β (rightward) at the contact C1. Then, bristles B on the downstream side in the moving direction of the belt 30 (i.e., forward in direction β, hence on the right-hand side) are pushed and flexed toward the downstream (rightward) by bristles B on the upstream side in the moving direction of the belt 30 (i.e., in the opposite direction from direction β, hence on the left-hand side). In this manner, the downstream bristles B are flexed by contacting the belt 30 and also by being pushed by the upstream bristles B contacting the belt 30. As a result, the bristles B on the downstream side from the contact C1 are flexed by being pushed by the upstream bristles B even when they are out of contact with the belt 30. Thus, the impact of the bristles B hitting the belt 30 at the contact C1 reaches the bristles B on the downstream side from the contact C1. The distance between the right end of the contact C1 and the bristle B that is affected by such impact will be referred to below as the distance D2.

Here, the amount of flexing d" of the bristle B is maximized at the center of the contact C1 in the left-right direction. The maximum value for the amount of flexing d" of the bristle B is approximately equal to the amount of bite d. Accordingly, the bristle B can contact bristles B to the right thereof within the same distance as the amount of bite d. As a result, the impact of a bristle B contacting the belt 30 reaches bristles B to the right thereof within the same distance as the amount of bite d. Thus, the distance D2 greatly depends on the amount of bite d. Accordingly, there is a possibility where toner T might leap out of the bristle B located to the right of the contact C1 at the same distance as the amount of bite d, and readhere to the belt 30.

Therefore, the distance X between the tip of the shielding member 56 and the contact C1 is designed to be shorter than the distance D2. As a result, the shielding member 56 prevents the toner T from readhering to the belt 30. The distance D2 depends on the amount of flexing d" of the bristle B. Since the amount of flexing d" is approximately equal to the amount of bite d, the distance D2 depends on the amount of bite d. The distance D2 is determined by the amount of charge in the toner, the direction and intensity of electric field, centrifugal force and air resistance applied to the toner, etc. However, normally, the readhering toner has weak charge, and therefore, is electrically weak, and centrifugal force and air resistance applied to the toner are not very significant. Therefore, the distance D2 greatly depends on the amount of bite d. The present inventors conducted experimentation to be described later and confirmed that the above hypothetical effect could actually be produced. Thus, the minimum distance X between the tip of the shielding member 56 and the contact C1 is preferably less than the amount of bite d.

The phenomenon as described in the above second reason occurs where the cleaning brush 44 has relatively high density bristles B. The fiber density of the cleaning brush 44 is, for example, about 120 kF inch$^2$, and therefore, both the phenomenon in the first reason and the phenomenon in the second reason conceivably occur.

Furthermore, the tip of the shielding member 56 has been described as being positioned at the contact C1. However, when the amount of bite Y in the contact C1 by the shielding member 56 is excessively high, the cleaning performance of the cleaning brush 44 decreases. The amount of bite Y refers to the distance between the right end of the contact C1 and the tip of the shielding member 56. The present inventors conducted experimentation to be described later, and confirmed that the tip of the shielding member 56 is preferably positioned at or to the right (forward in direction β) of the center of the contact C1 in the left-right direction.

Experimentation

To clearly define a preferred position of the shielding member 56, the present inventors conducted experimentation as will be described below. FIGS. 7A through 9C are enlarged views of cleaning brushes 44 and their vicinities in first through ninth experimental examples used in experimentation.

The present inventors made the first through tenth experimental examples. Each of the first through tenth experimental examples is a cleaning device 18 for cleaning the intermediate transfer belt 11. As shown in FIG. 1, the cleaning device 18 is directed 90 degrees to the cleaning device 40. However, for ease of understanding, the top-bottom direction, the left-right direction, and the front-back direction in FIGS. 7A through 9C refer to the same as the top-bottom direction, the left-right direction, and the front-back direction in FIG. 2.

The conditions that are common among the first through tenth experimental examples will be described below.

Feed speed of intermediate transfer belt 11: 300 mm/sec
Cleaning brush 44: conductive nylon brush
Fiber density of cleaning brush 44: 120 kF/inch$^2$
Thickness of bristle B of cleaning brush 44: 6 denier
Length of bristle B of cleaning brush 44: 4 mm
Resistance per unit length of raw yarn of cleaning brush 44: $10^{10}$ Ω·cm Diameter of cleaning brush 44: 18 mm Central core of cleaning brush 44: stainless steel, 10 mm in diameter Collecting roller 46: metal roller, 20 mm in diameter Roller 37: metal roller, 12 mm in diameter Position of roller 37: in front of cleaning brush 44 with intermediate transfer belt 11 inbetween Amount of bite din cleaning brush 44 by intermediate transfer belt 11: 1 mm Amount of bite in cleaning brush 44 by collecting roller 46: 1 mm Length of contact C1 in left-right direction: 8 mm Intermediate transfer belt 11: polyimide belt, $10^{10}$ Ω·cm in volume resistivity, and 80 μm in thickness Potential of roller 37: ground potential Potential V1 of cleaning brush 44: −100V Potential V2 of collecting roller 46: −200V Material of shielding member 56: nylon, about $10^8$ Ω·cm in resistance Thickness of shielding member 56: 80 μm Length of shielding member 56: 15 mm Dimension of shielding member 56 in front-back direction: 300 mm In the first experimental example shown in FIG. 7A, the distance X between the tip of the shielding member 56 and the contact C1 is 3 mm. In the second experimental example shown in FIG. 7B, the distance X between the tip of the shielding member 56 and the contact C1 is 1 mm. In the third experimental example shown in FIG. 7C, the distance X between the tip of the shielding member 56 and the contact C1 is 0.5 mm. In the fourth experimental example shown in FIG. 8A, the distance X between the tip of the shielding member 56 and the contact C1 is 0 mm.

Figure 8A:
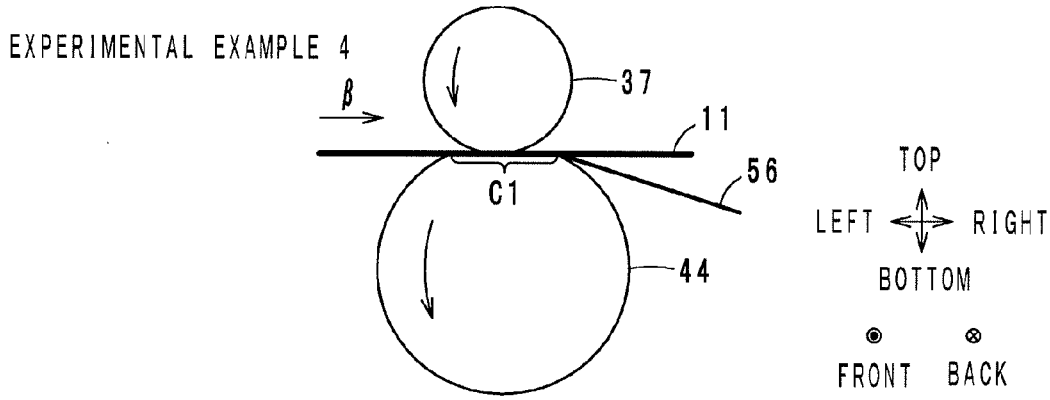
FIG. 8A is an enlarged view of a cleaning brush and its vicinity in a fourth experimental example used in experimentation.
Figure 8B:
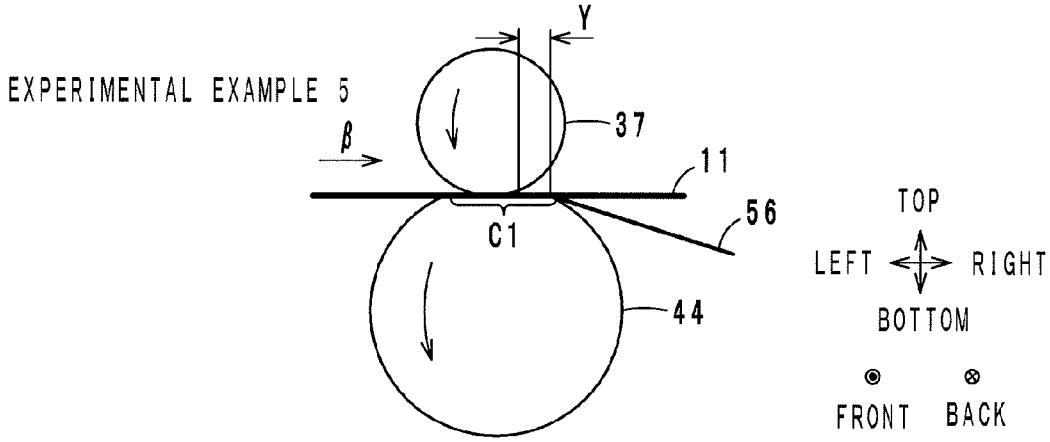
FIG. 8B is an enlarged view of a cleaning brush and its vicinity in a fifth experimental example used in experimentation.
Figure 8C:
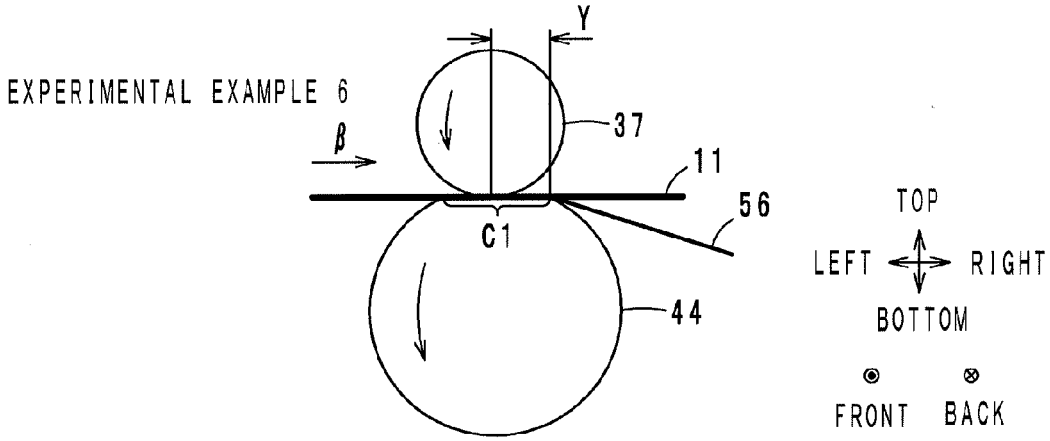
FIG. 8C is an enlarged view of a cleaning brush and its vicinity in a sixth experimental example used in experimentation.

In the fifth experimental example shown in FIG. 8B, the amount of bite Y in the contact C1 by the shielding member 56 is 2 mm. In the sixth experimental example shown in FIG. 8C, the amount of bite Y in the contact C1 by the shielding member 56 is 4 mm. In the seventh experimental example shown in FIG. 9A, the amount of bite Y in the contact C1 by the shielding member 56 is 6 mm. In the fifth through seventh experimental examples, the shielding member 56 sags near the right end of the contact C1 due to its softness. In addition, the shielding member 56 lies in part inside the boundary of the contact C1.

Figure 9A:
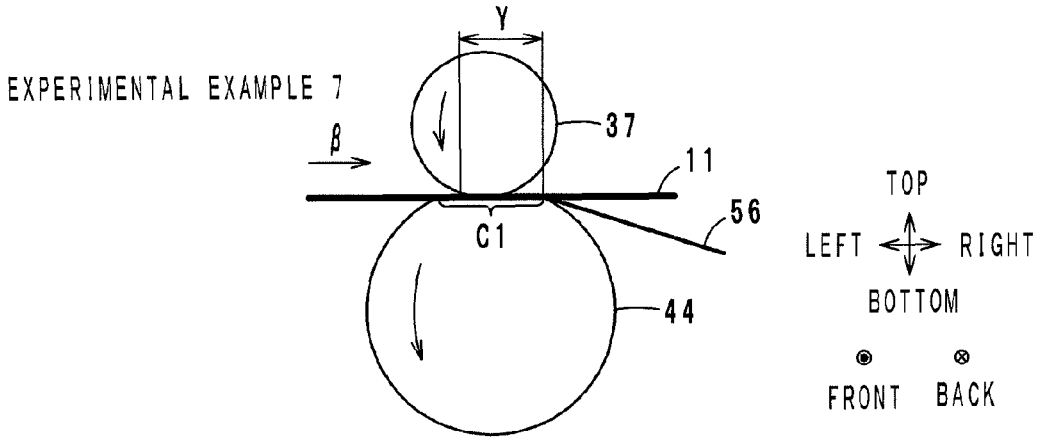
FIG. 9A is an enlarged view of a cleaning brush and its vicinity in a seventh experimental example used in experimentation.
Figure 9B:
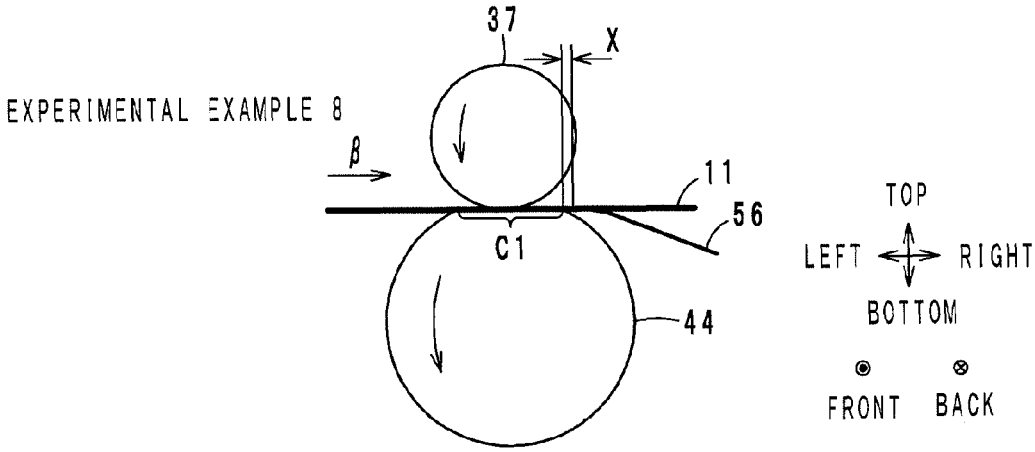
FIG. 9B is an enlarged view of a cleaning brush and its vicinity in an eighth experimental example used in experimentation.
Figure 9C:
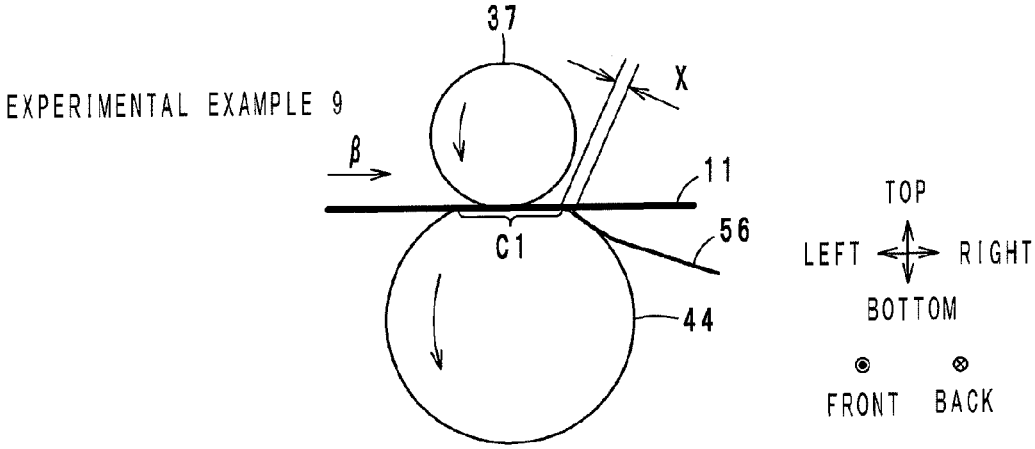
FIG. 9C is an enlarged view of a cleaning brush and its vicinity in a ninth experimental example used in experimentation.

In the eighth experimental example shown in FIG. 9B, the shielding member 56 is in contact with the intermediate transfer belt 11, and the distance X between the tip of the shielding member 56 and the contact C1 is 0.5 mm. In the eighth experimental example, the shielding member 56 sags due to its softness. In the ninth experimental example shown in FIG. 9C, the shielding member 56 is in contact with the cleaning brush 44, and the distance X between the tip of the shielding member 56 and the contact C1 is 0.5 mm. In the ninth experimental example, the shielding member 56 sags due to its softness. In the tenth experimental example, no shielding member 56 is provided. In the first through tenth experimental examples, none of the cleaning brush 50, the collecting roller 52 and the scraper 54 is provided. Table 1 shows the conditions for each experimental example.

TABLE 1

| | Distance X (mm) | Distance Y (mm) | Contact State of Tip of Shielding Member 56: With Cleaning Brush 44 | Contact State of Tip of Shielding Member 56: With Intermediate Ttransfer Belt 11 |
|---|---|---|---|---|
| Example 1 | 3 | — | Out of Contact | Out of Contact |
| Example 2 | 1 | — | Out of Contact | Out of Contact |
| Example 3 | 0.5 | — | Out of Contact | Out of Contact |
| Example 4 | 0 | 0 | In Contact | In Contact |
| Example 5 | — | 2 | In Contact | In Contact |
| Example 6 | — | 4 | In Contact | In Contact |
| Example 7 | — | 6 | In Contact | In Contact |
| Example 8 | 0.5 | — | Out of Contact | In Contact |
| Example 9 | 0.5 | — | In Contact | Out of Contact |
| Example 10 | — | — | — | — |

Uncleaned toner ΔE and readhering toner ΔE were measured for each of the first through tenth experimental examples. Specifically, in the first through tenth experimental examples, developing bias and transfer bias were adjusted such that the amount of adhering toner that remained on the intermediate transfer belt 11 after primary transfer was 1 g/m$^2$. Thereafter, the remaining toner was cleaned by the first through tenth experimental examples. The measurements of the uncleaned toner ΔE and the readhering toner ΔE were conducted using a spectrophotometric colorimeter to measure stains on sheets of paper with uncleaned toner and readhering toner. The size of toner image inputted to the cleaning device 40 was such that the dimension in the axial direction (in the figures, the front-back direction) was maximum for image formation (about 350 mm), and the dimension in the moving direction (in the figures, the left-right direction) was 50 mm. The uncleaned toner and the readhering toner adhered to separate positions on the sheet. The reason for this is that the readhering toner is toner that was gathered once by the brush and then stuck again to the belt on the downstream side at a moving distance of the belt from the uncleaned toner after a rotation with the brush. The uncleaned toner and the readhering toner could always adhere to the same positions so long as the relationship between the position in which to form an input toner image on the belt and the position of the sheet did not change. Therefore, by measuring stains at these positions on the sheet, values for the uncleaned toner ΔE and the readhering toner ΔE could be obtained. In this case, the spectrophotometric colorimeter was used to measure the color of the sheet and obtain L*a*b* values for the measured positions. Thereafter, color differences ΔE were calculated between the L*a*b* values for the measured positions and L*a*b* values for unstained positions on the sheet. Table 2 shows experimentation results.

TABLE 2

| | Uncleaned Toner ΔE | Readhearing Toner ΔE |
|---|---|---|
| Example 1 | 0.2 | 3.8 |
| Example 2 | 0.2 | 3.8 |
| Example 3 | 0.2 | 0.4 |
| Example 4 | 0.2 | 0.2 |
| Example 5 | 0.2 | 0.2 |
| Example 6 | 0.4 | 0.2 |
| Example 7 | 3.1 | 0.2 |
| Example 8 | 0.2 | 0.4 |
| Example 9 | 0.2 | 0.4 |
| Example 10 | 0.2 | 3.8 |

When the measured values for the uncleaned toner ΔE and the readhering toner ΔE were 0.5 or less, no stains on the sheet could be found without very careful inspection. Therefore, at values of 0.5 or less, the uncleaned toner ΔE and the readhering toner ΔE are not problematic. Moreover, with the uncleaned toner ΔE and the readhering toner ΔE at values of 0.2 or less, no stains on the sheet could be found even with very careful inspection. Therefore, at values of 0.2 or less, the uncleaned toner ΔE and the readhering toner ΔE are ideal. On the other hand, with the uncleaned toner ΔE and the readhering toner ΔE at values greater than 0.5, stains on the sheet could be found without careful inspection. Therefore, at values greater than 0.5, the uncleaned toner ΔE and the readhering toner ΔE are problematic.

In Table 2, for the tenth experimental example without the shielding member 56, the value for the uncleaned toner ΔE is 0.2, which is significantly low. On the other hand, the value for the readhering toner ΔE for the tenth experimental example is 3.8, far exceeding 0.5. That is, for the tenth experimental example, a significant amount of toner experienced readhesion.

Furthermore, the distance X between the tip of the shielding member 56 and the contact C1 was 3 mm for the first experimental example, and also 1 mm for the second experimental example. The tip of the shielding member 56 was not positioned at the contact C1, so that the value for the uncleaned toner ΔE was 0.2 for both of the examples. Therefore, it can be appreciated that high cleaning capability was achieved for both the first experimental example and the second experimental example. However, the value for the readhering toner ΔE was 3.8 for both of them. Therefore, it can be appreciated that, for the first experimental example and second experimental example, toner readhesion could not be sufficiently inhibited due to the significantly large distance X.

On the other hand, for the third experimental example, the distance X between the tip of the shielding member 56 and the contact C1 was 0.5 mm. Since the tip of the shielding member 56 was not positioned at the contact C1, the value for the uncleaned toner ΔE was 0.2. Therefore, it can be appreciated that high cleaning capability was achieved for the third experimental example. Moreover, the value for the readhering toner ΔE was 0.4. Therefore, it can be appreciated that toner readhesion can be sufficiently inhibited when the distance X is 0.5 mm or less. In addition, for the first through third experimental examples, when the distance X was 1 mm, the degree of toner readhesion was problematic, but when the distance X was 0.5 mm, the degree of toner readhesion was not problematic. Moreover, for the first through third experimental examples, the amount of bite d was 1 mm. Thus, it can be appreciated that toner readhesion can be inhibited when the distance X is less than the amount of bite d.

Furthermore, for the fourth experimental example, the tip of the shielding member 56 was positioned at the right end of the contact C1. Since the tip of the shielding member 56 was not positioned at the contact C1, the value for the uncleaned toner ΔE was 0.2. Moreover, the value for the readhering toner ΔE was 0.2. Therefore, it can be appreciated that, for the fourth experimental example, appropriate cleaning capability was achieved, and toner readhesion could be inhibited.

Furthermore, for the seventh experimental example, the amount of bite Y in the contact C1 by the shielding member 56 was 6 mm. The value for the readhering toner ΔE was 0.2 for the seventh experimental example. Therefore, it can be appreciated that, for the seventh experimental example, toner readhesion could be sufficiently inhibited. However, the value for the uncleaned toner ΔE was 3.1. It can be appreciated that, for the seventh experimental example, the amount of bite Y in the contact C1 by the shielding member 56 was excessively high, so that cleaning capability was low.

On the other hand, the amount of bite Y in the contact C1 by the shielding member 56 was 2 mm for the fifth experimental example, and also 4 mm for the sixth experimental example. The value for the readhering toner ΔE was 0.2 for both of the fifth experimental example and the sixth experimental example. Therefore, it can be appreciated that, for the fifth experimental example and the sixth experimental example, toner readhesion could be sufficiently inhibited. Moreover, the value for the uncleaned toner ΔE was 0.2 for the fifth experimental example, and also 0.4 for the sixth experimental example. Thus, it can be appreciated that a reduction in cleaning capability can be inhibited when the amount of bite Y is 4 mm or less. The dimension of the contact C1 in the left-right direction (direction β) was 8 mm. Therefore, for the fifth through seventh experimental examples, it is preferable that the tip of the shielding member 56 be positioned at or to the right (forward in direction β) of the center of the contact C1 in the left-right direction (in the following, the term "the center of the contact C1", unless otherwise stated, means the center of the contact C1 in the left-right direction).

The reason why the tip of the shielding member 56 is preferably positioned at or to the right of the center of the contact C1 will be further described. The amount of bite d in the cleaning brush 44 by the intermediate transfer belt 11 is maximized at the center of the contact C1 in the left-right direction. Accordingly, the force of the intermediate transfer belt 11 pressing the bristles B of the cleaning brush 44 is maximized at the center of the contact C1 in the left-right direction. Therefore, toner can be readily scraped from the intermediate transfer belt 11 by the bristles B at the center of the contact C1 in the left-right direction. Moreover, at the center of the contact C1 in the left-right direction, electrical resistance between the cleaning brush 44 and the roller 37 is minimized so that current flow is facilitated. This facilitates supply of charges that cause toner to adsorb to the bristles B. That is, at the center of the contact C1 in the left-right direction, toner on the intermediate transfer belt 11 can readily adsorb to the bristles B.

For the above two reasons, the capability of the brush cleaning toner on the intermediate transfer belt 11 is maximum at the center of the contact C1. Accordingly, if the shielding member 56 is positioned to the left of the center of the contact C1 in the left-right direction, the shielding member 56 interferes with cleaning of the intermediate transfer belt 11 by the cleaning brush 44. Thus, the tip of the shielding member 56 is preferably positioned at or to the right of the center of the contact C1 in the left-right direction.

Note that, to prevent discharge near the left or right end of the contact C1, the cleaning brush 44 may be displaced in the left-right direction so as to be out of alignment with the roller 37. In such a case, the tip of the shielding member 56 is positioned to the right of the intersection of the intermediate transfer belt 11 and a line extending between the center of the roller 37 and the center of the cleaning brush 44.

Furthermore, in the eighth experimental example, the shielding member 56 was in contact with the intermediate transfer belt 11. In the ninth experimental example, the shielding member 56 was in contact with the cleaning brush 44. From Table 2, it can be appreciated that, for both of the eighth experimental example and the ninth experimental example, toner readhesion was inhibited, and appropriate cleaning capability was achieved. Thus, the shielding member 56 may be in contact with either the intermediate transfer belt 11 or the cleaning brush 44.

Figures 10A, 10B, 10C:
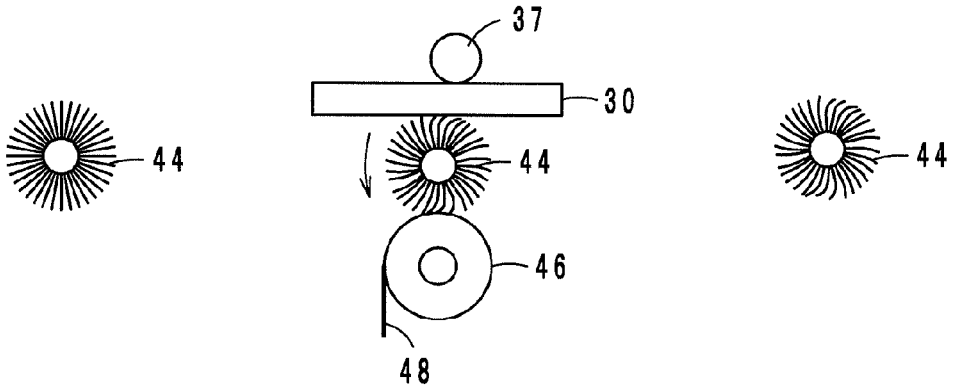
FIG. 10A is a diagram illustrating a cleaning brush not in use.
FIG. 10B is a diagram illustrating the cleaning brush in use.
FIG. 10C is a diagram illustrating the cleaning brush after a long period of use.
Figure 11:
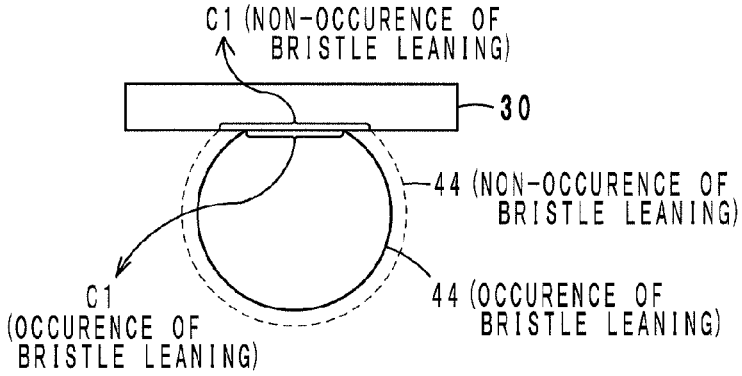
FIG. 11 is a diagram comparing the cleaning brush not in use and the cleaning brush after a long period of use.

Incidentally, in the present experimentation, the contact C1 was an area where the intermediate transfer belt 11 bit into and thereby contacted the cleaning brush 44. However, it is difficult to define the contact C1 exactly. Accordingly, the present inventors defined the contact C1 by the procedure to be described below. FIG. 10A is a diagram illustrating the cleaning brush 44 not in use. FIG. 10B is a diagram illustrating the cleaning brush 44 in use. FIG. 10C is a diagram illustrating the cleaning brush 44 after a long period of use. FIG. 11 is a diagram comparing the cleaning brush 44 not in use and the cleaning brush 44 after a long period of use.

As shown in FIG. 10A, the cleaning brush 44 not in use has bristles B extending radially from the central core. Once the cleaning brush 44 starts rotating, the bristles B are elastically deformed so as to lean in the opposite direction from the direction of rotation, as shown in FIG. 10B, due to contact between the intermediate transfer belt 11 and the collecting roller 46 and air resistance. However, once the cleaning brush 44 stops rotating, the cleaning brush 44 returns to the state shown in FIG. 10A.

However, after the cleaning brush 44 has been used for a long period of time, the bristles B of the cleaning brush 44 tend to remain leaning, as shown in FIG. 10C, even after the cleaning brush 44 stops rotating. The reason for this is that the bristles B have experienced plastic deformation. The phenomenon where the bristles B of the cleaning brush 44 remain leaning even after the cleaning brush 44 stops rotating will be referred to below as "bristle leaning". When bristle leaning occurs, the cleaning brush 44 is reduced in diameter, as shown in FIG. 11. Correspondingly, the dimension of the contact C1 in the left-right direction is reduced as well.

In this manner, the dimension of the contact C1 in the left-right direction varies depending on whether the cleaning brush 44 is rotating, at rest, or after a long period of use. Moreover, it is not easy to measure the diameter of the cleaning brush 44 which is rotating. Thus, it is difficult to define the contact C1.

Figure 12A:
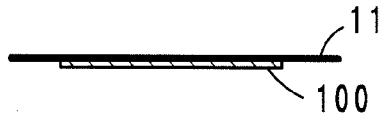
FIG. 12A is a diagram describing experimentation to define the contact C1.
Figure 12B:
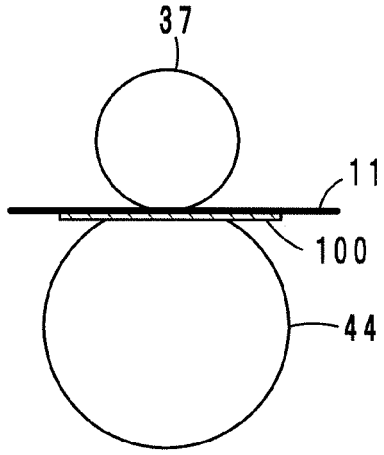
FIG. 12B is another diagram describing the experimentation to define the contact C1.
Figure 12C:
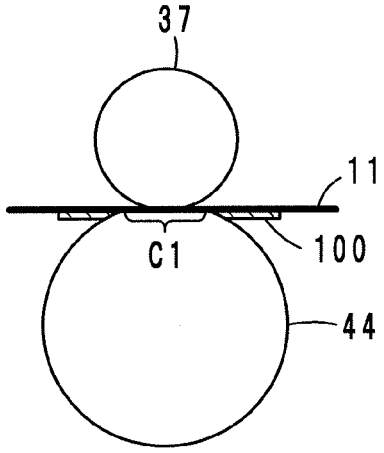
FIG. 12C is another diagram describing the experimentation to define the contact C1.

Therefore, the present inventors defined the contact C1 in accordance with the procedure to be described below. FIGS. 12A, 12B, and 12C are diagrams describing experimentation to define the contact C1.

First, a thin layer of coating 100 is applied to the intermediate transfer belt 11 at rest, as shown in FIG. 12A. Next, the roller 37 and the cleaning brush 44 are placed with the same amount of bite d (1 mm) as in the first through tenth experimental examples, as shown in FIG. 12B. Thereafter, the roller 37 and the cleaning brush 44 are operated under the same conditions (rotating speed and bias) as in the first through tenth experimental examples. Note that the intermediate transfer belt 11 is not driven. As a result, the cleaning brush 44 removes the coating from the contact C1, which is an area where the intermediate transfer belt 11 and the cleaning brush 44 are in contact with each other, as shown in FIG. 12C. That is, the area with the coating removed is the contact C1. That is the procedure employed by the present inventors to define the contact C1.

Next, the present inventors measured uncleaned toner ΔE and readhering toner ΔE using shielding members 56 of different materials, resistance values, and thicknesses. The present inventors produced eleventh through fourteenth experimental examples. The eleventh through fourteenth experimental examples had the same configuration as the fifth experimental example. Table 3 shows conditions and experimentation results for each of the experimental examples.

TABLE 3

| | Material | Resistance | Thickness (μm) | Uncleaned Toner ΔE |
|---|---|---|---|---|
| Example 11 | PET | Insulating | 40 | 0.2 |
| Example 12 | PET | Insulating | 110 | 0.2 |
| Example 13 | Nylon | 10E6 | 80 | 0.2 |
| Example 14 | SUS | Conducting | 50 | 0.2 |

It can be appreciated from Table 3 that, for all of the eleventh through fourteenth experimental examples, appropriate cleaning capability was achieved, and toner readhesion could be inhibited. Therefore, it can be appreciated that any of the following can be used as the material of the shielding member 56: polyethylene terephthalate (PET), nylon, and stainless steel. Moreover, the shielding member 56 may have insulating properties, a significantly high resistance value, or conducting properties. It can also be appreciated that no problem occurs when the shielding member 56 has a thickness of from 40 μm to 110 μm.

Shielding Members According to First and Second Modifications

Figure 13A:
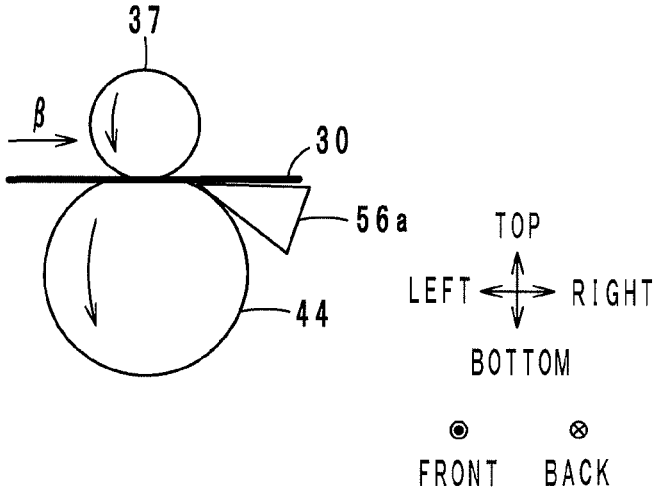
FIG. 13A is a diagram illustrating a shielding member according to a first modification.
Figure 13B:
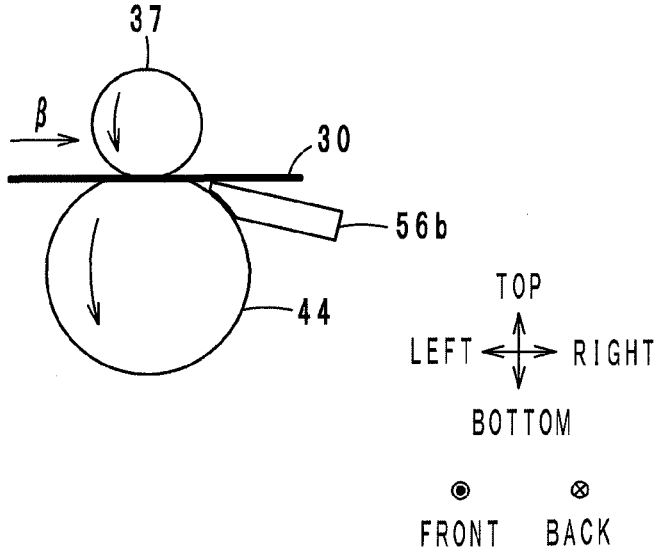
FIG. 13B is a diagram illustrating a shielding member according to a second modification.

Shielding members 56*a* and 56*b* according to first and second modifications will be described below with reference to the drawings. FIG. 13A is a diagram illustrating the shielding member 56*a* according to the first modification. FIG. 13B is a diagram illustrating the shielding member 56*b* according to the second modification.

As shown in FIG. 13A, the shielding member 56*a* has a triangular (wedge-shaped) cross section. The shielding member 56*a* is disposed with its vertex positioned near the contact C1.

As shown in FIG. 13B, the shielding member 56*b* has a plate-like shape. However, the lower left corner of the shielding member 56*b* is shaped so as to conform with the circumferential surface of the cleaning brush 44, so that the shielding member 56*b* does not bite into the cleaning brush 44 excessively.

Cleaning Devices According to First and Second Modifications

Figure 14A:
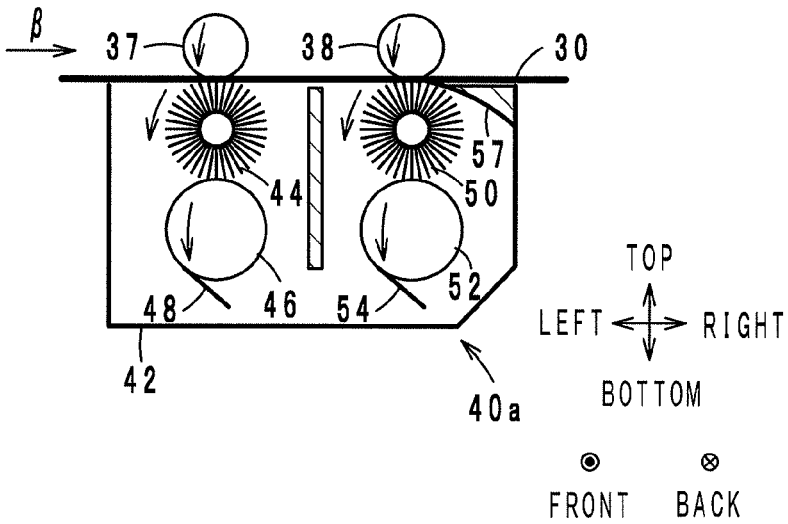
FIG. 14A is a configuration diagram of a cleaning device according to the first modification.
Figure 14B:
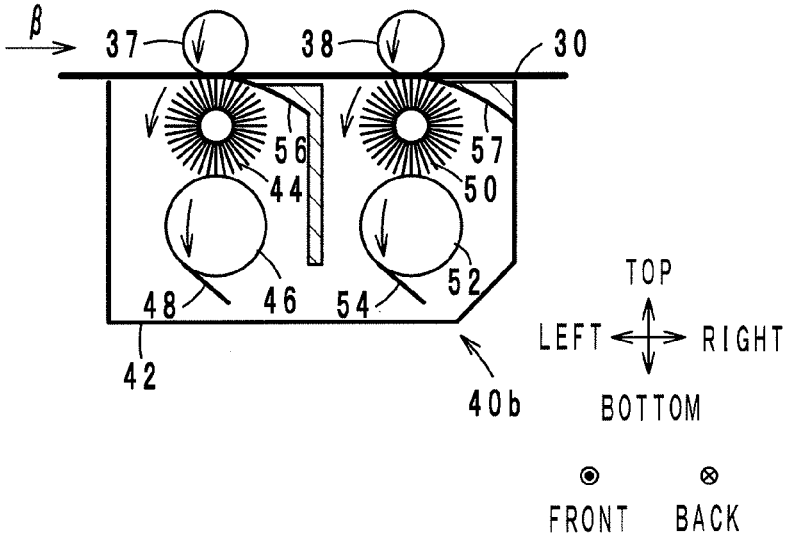
FIG. 14B is a configuration diagram of a cleaning device according to the second modification.

Cleaning devices 40*a* and 40*b* according to the first and second modifications will be described below with reference to the drawings. FIG. 14A is a configuration diagram of the cleaning device 40*a* according to the first modification. FIG. 14B is a configuration diagram of the cleaning device 40*b* according to the second modification.

As shown in FIG. 14A, the cleaning device 40*a* has a shielding member 57 provided to a cleaning brush 50 located on the downstream side in the moving direction of the belt 30 (direction β).

When toner on the cleaning brush 50 readheres to the belt 30, the toner is carried on the belt 30 to the outside of the cleaning device 40*a* without being collected. Therefore, the cleaning device 40*a* has the shielding member 57 provided to the cleaning brush 50. As a result, readhering toner is inhibited from being carried on the belt 30 to the outside of the cleaning device 40*a*.

Furthermore, most toner is collected by the cleaning brush 44. Therefore, the toner that is collected by the cleaning brush 50 is, for example, weakly charged toner, oppositely charged toner, or toner whose charged state is prone to vary. These types of toner readily readhere to the belt 30. Therefore, by providing the cleaning brush 50 with the shielding member 57, it is rendered possible to more effectively inhibit toner readhesion.

As shown in FIG. 14B, the cleaning device 40*b* has a shielding member 56 provided to a cleaning brush 44, and a shielding member 57 to a cleaning brush 50. As a result, toner readhesion to the cleaning brushes 44 and 50 is inhibited. Note that the cleaning device 40 may be provided with three or more cleaning brushes, each being provided with a shielding member.

Cleaning Device According to Third Modification

Figure 15:
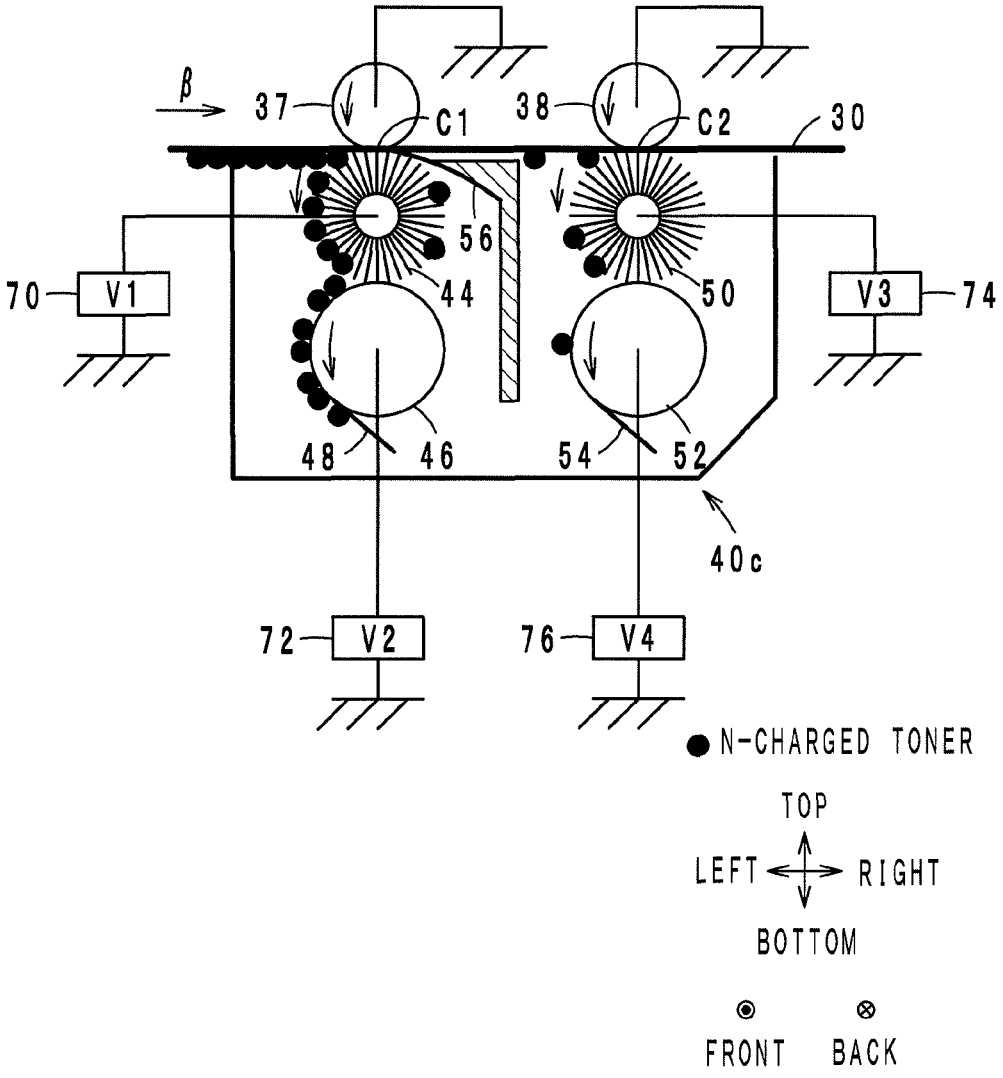
FIG. 15 is a configuration diagram of a cleaning device according to a third modification.

A cleaning device 40*c* according to a third modification will be described below with reference to the drawings. FIG. 15 is a configuration diagram of the cleaning device 40*c* according to the third modification.

There may be a tendency for toner of one polarity to adhere to the belt 30. In such a case, the cleaning brush 44 and the cleaning brush 50 may be adapted to collect toner of the same polarity.

Therefore, in the cleaning device 40*c*, the potential V3 of the cleaning brush 50 is designed to be positive. That is, the potential V3 of the cleaning brush 50 is equal in polarity to the potential V1 of the cleaning brush 44.

Furthermore, in the cleaning device 40*c*, the potential V4 of the collecting roller 52 is positive. That is, the potential V4 of the collecting roller 52 is equal in polarity to the potential V2 of the collecting roller 46.

The cleaning device 40*c* thus configured is effective in the case where a large amount of negatively charged toner adheres to the belt 30, and therefore, the cleaning brush 44 gathers a large amount of toner. In the case where the cleaning brush 44 gathers a large amount of toner, a significant amount of toner might remain on the cleaning brush 44 without being collected by the collecting roller 46. As a result, a significant amount of toner might readhere to the belt 30 at the contact C1. Therefore, the cleaning brush 44 is provided with the shielding member 56, thereby inhibiting toner readhesion. In this case, the toner that has not been collected by the first rotation of the collecting roller 46 rotates with the brush without readhering to the belt 30, and therefore can eventually be collected by the collecting roller 46 while the brush is making rotations, so that a large amount of toner can be collected without difficulty. Therefore, the cleaning brush 50 simply gathers the toner that remains on the belt 30 without being removed by the cleaning brush 44. Thus, the load on the cleaning brush 50 can be reduced.

Cleaning Device According to Fourth Modification

Figure 16:
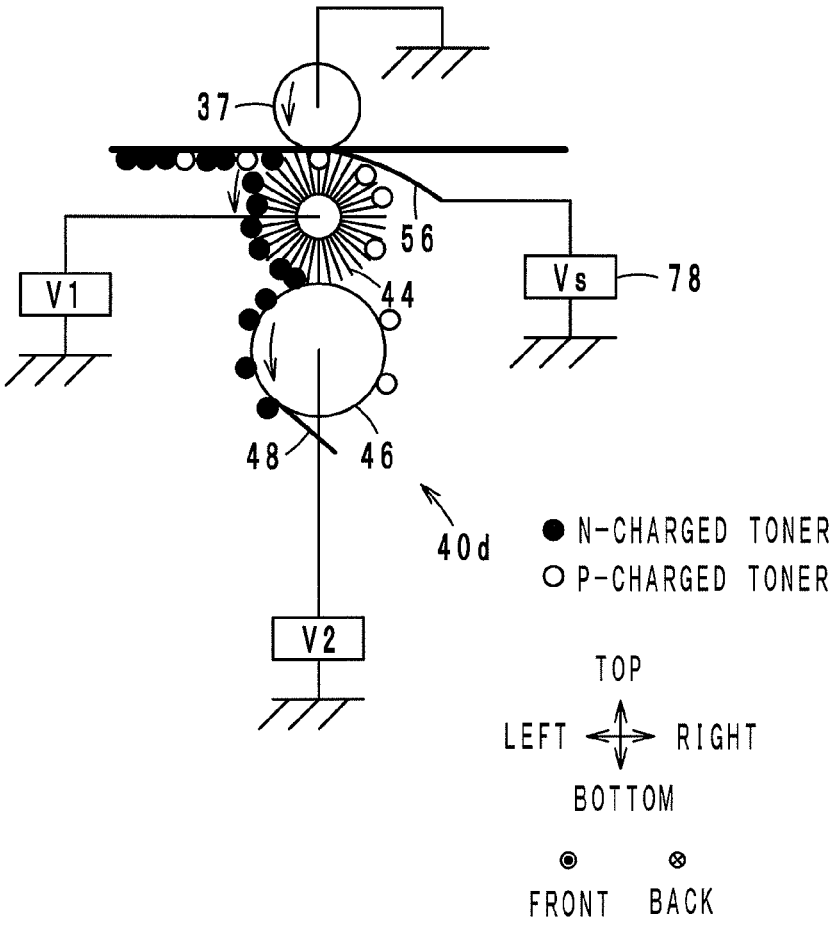
FIG. 16 is a configuration diagram of a cleaning device according to a fourth modification.
Figure 17:
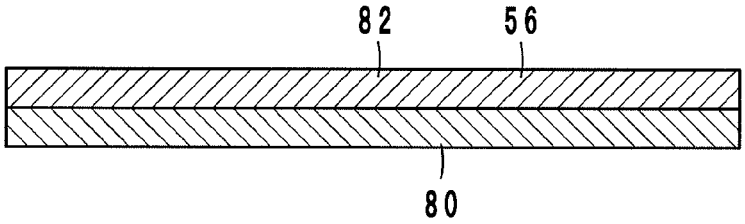
FIG. 17 is a diagram illustrating another example of the shielding member.

A cleaning device 40*d* according to a fourth modification will be described below with reference to the drawings. FIG. 16 is a configuration diagram of the cleaning device 40*d* according to the fourth modification. FIG. 17 is a diagram illustrating another example of the shielding member 56.

As described earlier, negatively charged toner might be changed into positively charged toner (oppositely charged toner) or weakly charged toner by discharge or charge injection, which occurs between the cleaning brush 44 and the collecting roller 46. The oppositely charged toner and the weakly charged toner are prone to readhere to the belt 30, without being collected by the collecting roller 46, due to electrostatic force between the cleaning brush 44 and the belt 30.

Therefore, the shielding member 56 of the cleaning device 40*d* is made of a conductive material. A power source 78 applies a voltage to the shielding member 56 such that the potential of the shielding member 56 is negative relative to the potential of the cleaning brush 44 (i.e., the potential of the shielding member 56 differs from the potential of the cleaning brush 44). Specifically, the potential Vs is such that $\Delta V<0$ where $\Delta V=Vs-V1$. Moreover, the shielding member 56 is disposed in contact with the tip of the cleaning brush 44. As a result, oppositely charged toner and weakly charged toner are subjected to charge injection by the shielding member 56, and thereby turn into negatively charged toner. Consequently, the negatively charged toner is carried on the cleaning brush 44 and collected by the collecting roller 46. Note that, so long as the tip of the shielding member 56 is positioned at or to the right of the center of the contact between the belt 30 and the cleaning brush 44, the position of the shielding member 56 does not affect the cleaning brush 44 in collecting the negatively charged toner that adheres to the belt 30. Moreover, the tip of the shielding member 56 is preferably out of contact with the belt 30.

Note that the shielding member 56 may be made of a conductive material, but the shielding member 56 may have a conductive electrode layer 80 provided on an insulating substrate 82, as shown in FIG. 17. The substrate 82 is resistive so that current for charge injection into toner can be prevented from flowing through the belt 30, thereby causing power loss and unstable potential.

Cleaning Devices According to Fifth and Sixth Modifications

Figure 18:
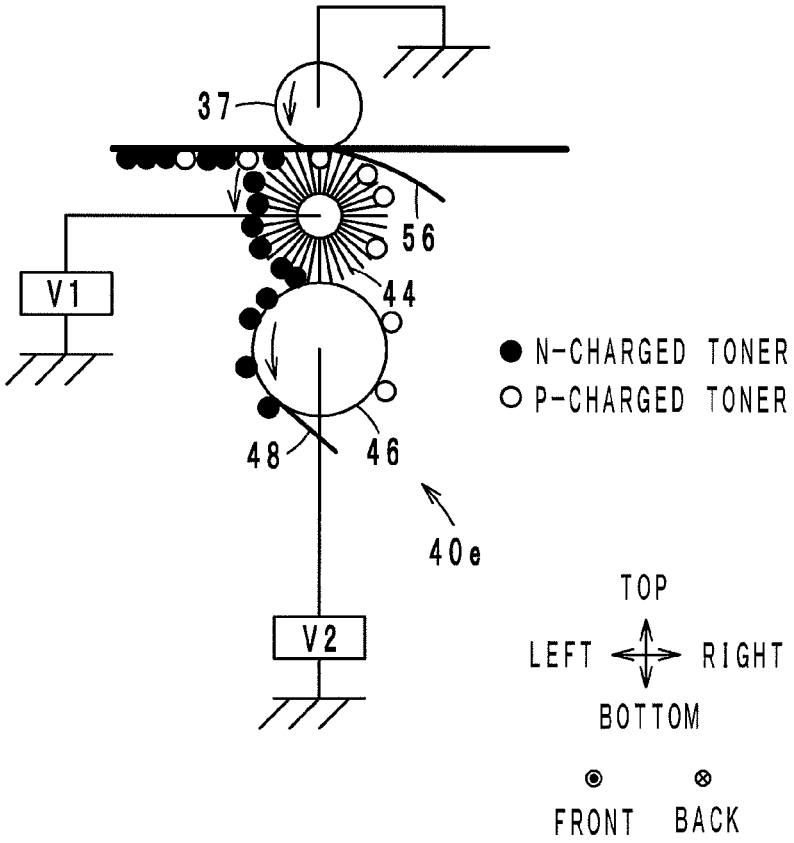
FIG. 18 is a configuration diagram of a cleaning device according to a fifth modification.
Figure 19:
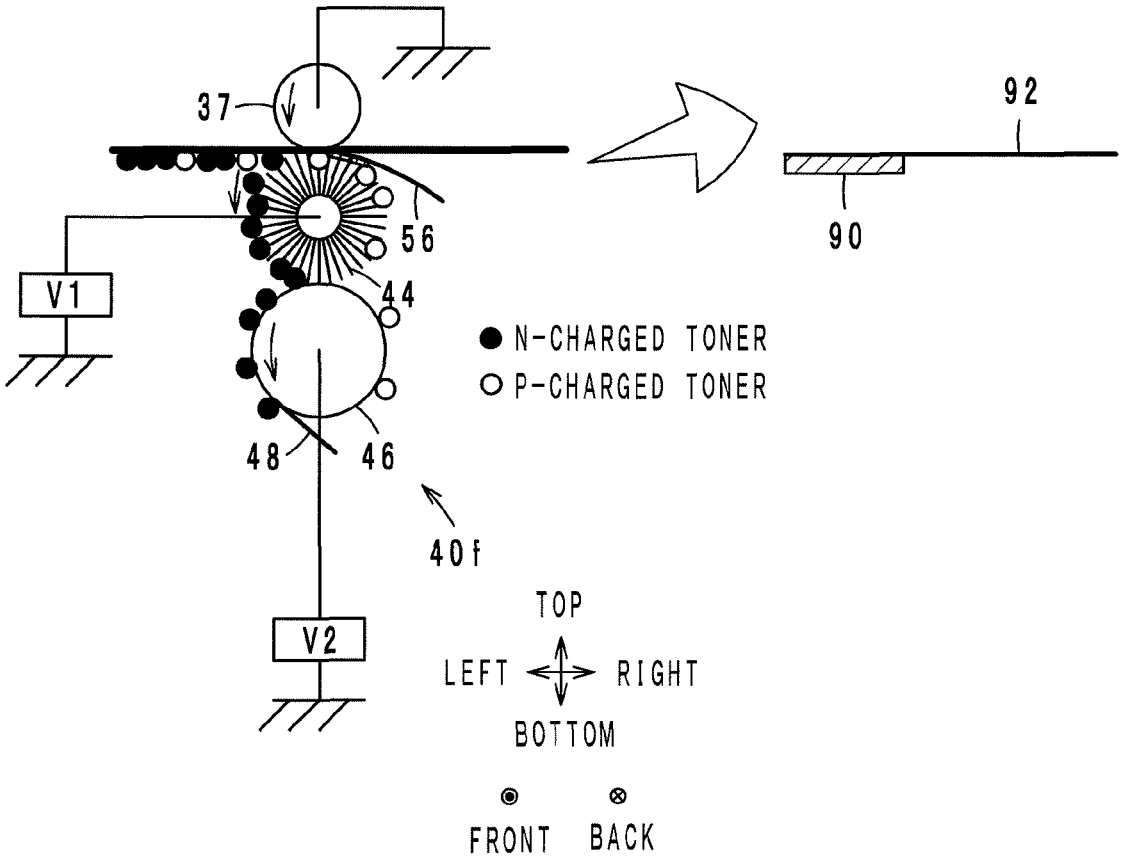
FIG. 19 is a configuration diagram of a cleaning device according to a sixth modification.

Cleaning devices 40*e* and 40*f* according to fifth and sixth modifications will be described below with reference to the drawings. FIG. 18 is a configuration diagram of the cleaning device 40*e* according to the fifth modification. FIG. 19 is a configuration diagram of the cleaning device 40*f* according to the sixth modification.

The shielding member 56 of the cleaning device 40*e* changes positively charged toner (oppositely charged toner) into negatively charged toner by subjecting the toner to charge injection through frictional charging with toner adhering to the cleaning brush 44. Note that the shielding member 56 may change negatively charged toner (normally charged toner) into positively charged toner by subjecting the toner to charge injection through frictional charging with toner adhering to the cleaning brush 44.

Therefore, the relationship between the surface of the shielding member 56 and the toner in the triboelectric series is such that the toner can be collected through frictional charging. For example, in the case of polyester toner, the surface of the shielding member 56 is composed of nylon in order to negatively charge the toner. On the other hand, to positively charge polyester toner, the surface of the shielding member 56 is composed of, polyvinylidene fluoride (PVDF), polytetrafluoroethylene (PTFE), fluororesin, or the like.

Furthermore, the shielding member 56 may include a frictional charging layer 90 and a substrate 92, as in the cleaning device 40*f* shown in FIG. 19. The substrate 92 is an insulating sheet. The frictional charging layer 90 is provided on a tip potion of the substrate 92 so as to contact the cleaning brush 44. Therefore, the frictional charging layer 90 changes positively charged toner into negatively charged toner by subjecting the toner to charge injection through frictional charging therewith.

In the case of the cleaning devices 40*e* and 40*f*, the shielding member 56 inhibits toner readhesion to the belt 30 even if the amount of charge in the toner cannot be changed to a desired level in a single incident of charge injection or frictional charging. Accordingly, there is a chance that toner adhering to the cleaning brush 44 contacts or approaches the shielding member 56 through more than one rotation. As a result, the toner is repeatedly rotated with the cleaning brush 44 to be collected by the collecting roller 46 when the amount of charge therein reaches such a level that allows collection by the collecting roller 46.

Cleaning Devices According to Seventh Through Ninth Modifications

Figure 20A:
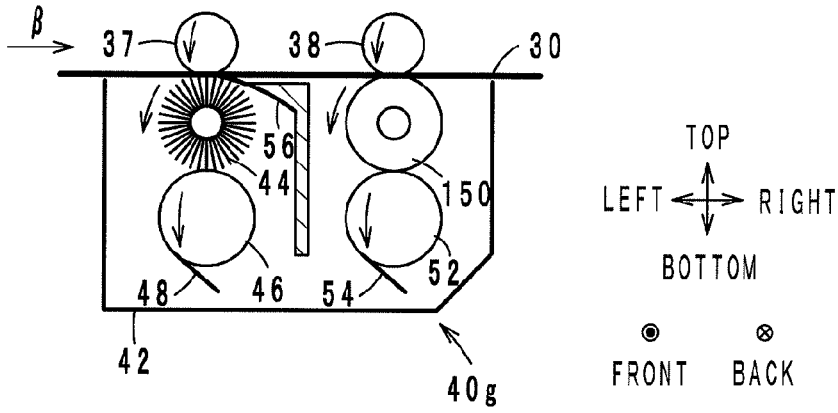
FIG. 20A is a configuration diagram of a cleaning device according to a seventh modification.
Figure 20B:
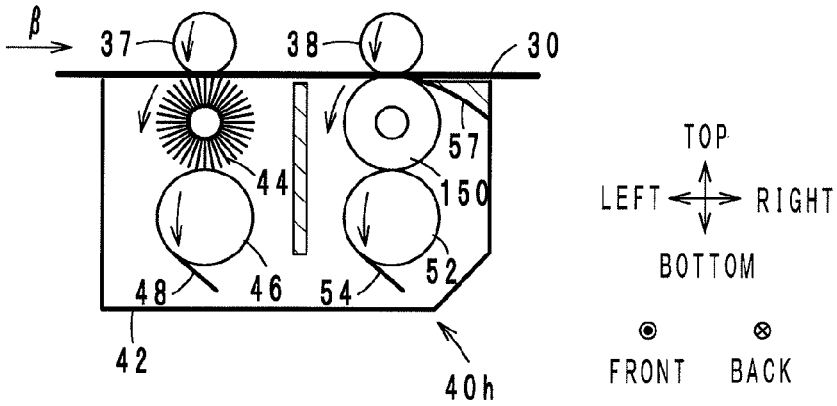
FIG. 20B is a configuration diagram of a cleaning device according to an eighth modification.
Figure 20C:
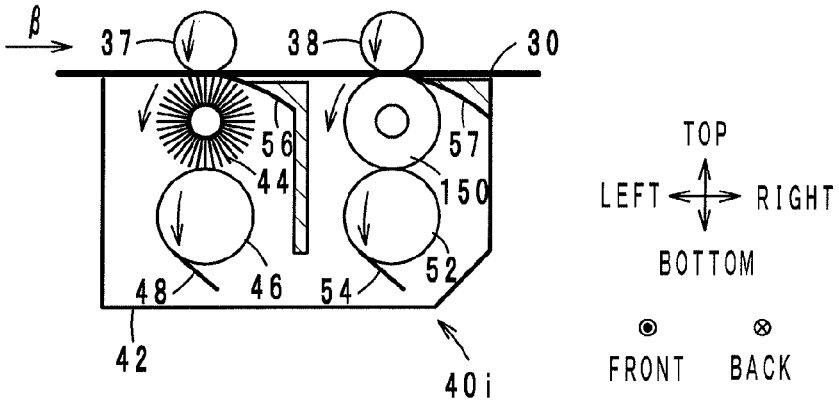
FIG. 20C is a configuration diagram of a cleaning device according to a ninth modification.
Figure 21:
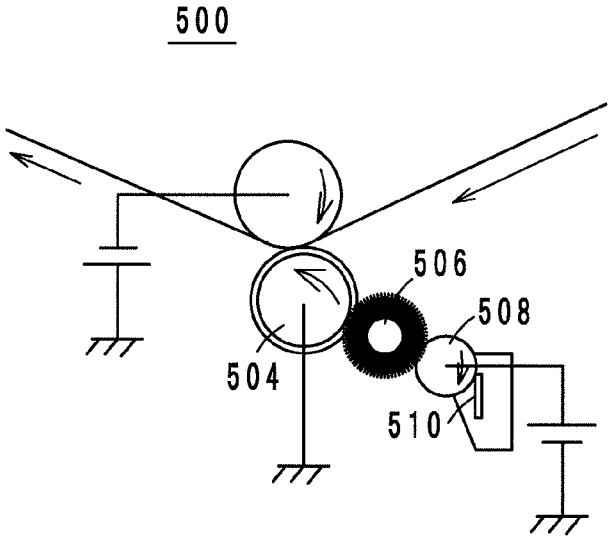
FIG. 21 is a configuration diagram of a cleaning device described in Japanese Patent Laid-Open Publication No. 2007-334011.

Cleaning devices 40*g*, 40*h*, and 40*i* according to seventh, eighth, and ninth modifications will be described below with reference to the drawings. FIG. 20A is a configuration diagram of the cleaning device 40*g* according to the seventh modification. FIG. 20B is a configuration diagram of the cleaning device 40*h* according to the eighth modification. FIG. 20C is a configuration diagram of the cleaning device 40*i* according to the ninth modification.

The cleaning device 40*g* uses a cleaning roller 150 in place of the cleaning brush 50. The cleaning roller 150 is a so-called foam roller (sponge roller) made of conductive resin having a bubble (cell) structure, such as polyethylene, polyurethane, or nitrile butadiene rubber (NBR). In the case of the foam roller, the cell is significantly deformed by contacting the belt 30, so that toner leaps out from the cleaning roller 150 due to the impact and flowing air at the time of the contact. Then, the toner readheres to the belt 30 due to electrostatic force between the cleaning roller 150 and the belt 30. Therefore, the cleaning device 40*g* is also provided with the shielding member 56 in order to inhibit toner readhesion.

The cleaning roller 150, which is a foam roller, contacts the belt 30 with the outermost surfaces of cells and scrapes toner off the belt 30 with walls of the cells. Accordingly, the strength of the mechanical scraping action of the cleaning roller 150 is higher than the strength of the mechanical scraping action of the cleaning brush 44, and therefore the cleaning roller 150 can collect toner from the belt 30 regardless of the polarity of the toner.

In this manner, the cleaning roller 150 is provided on the downstream side in the moving direction of the belt 30 (forward in direction β), and therefore can collect weakly or oppositely charged toner that is left uncollected by the cleaning brush 44 and also toner that firmly adheres to the belt 30.

Note that the shielding member 57 may be provided to the cleaning roller 150, as in the cleaning device 40*h*. Moreover, the shielding members 56 and 57 may be respectively provided to the cleaning brush 44 and the cleaning roller 150, as in the cleaning device 40*i*.

Other Embodiments

The present invention is not limited to the cleaning devices 40 and 40*a* to 40*i*, and variations can be made within the sprit of the invention.

Furthermore, in the image forming apparatus 1, a toner image on the photoreceptor drum 4 (4Y, 4M, 4C, 4K) is initially transferred to the intermediate transfer belt 11, and thereafter subjected to secondary transfer onto a sheet of paper. However, the image forming apparatus 1 may transfer a toner image on the photoreceptor drum 4 (4Y, 4M, 4C, 4K) to a sheet of paper without using the intermediate transfer belt 11.

Note that features of the cleaning devices 40 and 40*a* to 40*i* may be used in combination.

Although the present invention has been described in connection with the preferred embodiment above, it is to be noted that various changes and modifications are possible to those who are skilled in the art. Such changes and modifications are to be understood as being within the scope of the invention.

What is claimed is:

1. A cleaning device for cleaning a cleaning subject moving in a predetermined direction, comprising:

a cleaning member that rotates in an opposite direction from the predetermined direction at a contact with the cleaning subject, thereby gathering toner from the cleaning subject; and a shielding member that is disposed between the cleaning member and the cleaning subject in the predetermined direction relative to the contact and prevents the toner on the cleaning member from moving to the cleaning subject, wherein a voltage is applied between the cleaning subject and the cleaning member such that the toner moves from the cleaning subject to the cleaning member, the toner includes toner charged with a first polarity and toner charged with a second polarity, and the toner charged with the second polarity is changed into toner charged with the first polarity by the shielding member being provided with a voltage of a potential different from a potential of the cleaning member.

2. The cleaning device according to claim 1, wherein the shielding member has a tip positioned at or near the contact in the opposite direction from the predetermined direction.

3. The cleaning device according to claim 1, wherein the cleaning member is a cylindrical brush.

4. The cleaning device according to claim 3, wherein a minimum distance between the contact and the tip of the shielding member in the opposite direction from the predetermined direction is less than a difference between a radius of the brush and a minimum distance from a center of the brush to the cleaning subject.

5. The cleaning device according to claim 1, wherein the tip of the shielding member in the opposite direction from the predetermined direction is positioned at or ahead of a center of the contact in the predetermined direction.

* * * * *